US011498182B2

(12) United States Patent
Kamada et al.

(10) Patent No.: US 11,498,182 B2
(45) Date of Patent: Nov. 15, 2022

(54) POLISHING METHOD AND POLISHING PAD

(71) Applicant: FUJIMI INCORPORATED, Kiyosu (JP)

(72) Inventors: Toru Kamada, Aichi (JP); Koji Katayama, Aichi (JP); Hitoshi Morinaga, Aichi (JP); Takashi Horibe, Aichi (JP)

(73) Assignee: FUJIMI INCORPORATED, Kiyosu (JP)

( * ) Notice: Subject to any disclaimer, the term of this patent is extended or adjusted under 35 U.S.C. 154(b) by 907 days.

(21) Appl. No.: 16/074,668

(22) PCT Filed: Feb. 20, 2017

(86) PCT No.: PCT/JP2017/006224
§ 371 (c)(1),
(2) Date: Aug. 1, 2018

(87) PCT Pub. No.: WO2017/146006
PCT Pub. Date: Aug. 31, 2017

(65) Prior Publication Data

US 2019/0070707 A1 Mar. 7, 2019

(30) Foreign Application Priority Data

Feb. 26, 2016 (JP) ..... 2016-036183
Feb. 26, 2016 (JP) ..... JP2016-036182
Mar. 29, 2016 (JP) ..... 2016-066307

(51) Int. Cl.
*B24B 37/22* (2012.01)
*B24B 29/00* (2006.01)
(Continued)

(52) U.S. Cl.
CPC ..... *B24B 37/22* (2013.01); *B24B 19/26* (2013.01); *B24B 29/00* (2013.01); *B24B 29/02* (2013.01);
(Continued)

(58) Field of Classification Search
CPC ..... B24B 37/20; B24B 37/22; B24B 37/26; B24B 29/02; B24B 19/26; B24B 19/265; B24D 13/14
See application file for complete search history.

(56) References Cited

U.S. PATENT DOCUMENTS 6,464,576 B1 * 10/2002 Freeman ..... B24B 37/22 451/533
6,783,437 B1 * 8/2004 He ..... B24B 37/22 451/211
(Continued)

FOREIGN PATENT DOCUMENTS

JP 2001-170872 A 6/2001
JP 2002-103239 A 4/2002
(Continued)

*Primary Examiner* — Joel D Crandall
(74) *Attorney, Agent, or Firm* — Foley & Lardner LLP

(57) ABSTRACT

A disc-shaped polishing pad (1) is used for a polishing method of the present invention. The polishing pad (1) has a peripheral surface (111) on a polishing surface (10) side in an axial direction of the disc of a tapered surface whose diameter is reduced to the polishing surface (10). An angle formed by the peripheral surface (111) and the polishing surface (10) is 125° or more and less than 180°. The polishing pad (1) has a hardness immediately after a pressing surface is in close contact of 40 or more by a testing method specified in an appendix 2 of JIS K7312: 1996, "Spring Hardness Test Type C Testing Method". A slurry containing abrasives is supplied to a polished surface larger than the polishing surface (10). The polishing surface (10) is
(Continued)

pressed against the polished surface and the polishing pad (1) is moved to polish the polished surface.

12 Claims, 14 Drawing Sheets

(51) Int. Cl.

| | |
|---|---|
| ***B24B 37/24*** | (2012.01) |
| ***B24D 13/14*** | (2006.01) |
| ***B24B 19/26*** | (2006.01) |
| ***B24B 29/02*** | (2006.01) |
| ***B24B 37/26*** | (2012.01) |

(52) U.S. Cl.
CPC ..... *B24B 37/24* (2013.01); *B24B 37/245* (2013.01); *B24B 37/26* (2013.01); *B24D 13/14* (2013.01); *B24D 13/142* (2013.01)

(56) References Cited

U.S. PATENT DOCUMENTS

2002/0004360 A1* 1/2002 Ota ..... C09G 1/02 451/60
2002/0037681 A1* 3/2002 Gitis ..... B24B 49/10 451/5
2002/0182993 A1* 12/2002 Ueno ..... B24D 9/08 451/353
2006/0053576 A1 3/2006 McLain
2007/0049167 A1 3/2007 Swedek et al.
2007/0066185 A1* 3/2007 Felipe ..... B24B 7/20 451/41
2007/0243798 A1* 10/2007 Annen ..... B24D 3/002 451/28
2008/0233837 A1* 9/2008 Annen ..... B24B 1/00 451/37
2009/0093202 A1* 4/2009 Fukuda ..... B24B 37/205 451/533
2009/0209185 A1* 8/2009 Motonari ..... B24B 37/26 451/527
2009/0298399 A1* 12/2009 Albrecht ..... B24B 37/30 451/259
2011/0189927 A1 8/2011 Lipson
2012/0083187 A1* 4/2012 Okamoto ..... C08G 18/4854 451/28
2013/0137350 A1 5/2013 Allison et al.
2017/0144266 A1 5/2017 Sato
2017/0252892 A1 9/2017 Katayama et al.

FOREIGN PATENT DOCUMENTS

JP 2003-266298 A 9/2003
JP 2008-512263 A 4/2008
JP 2009-220265 A 10/2009
JP 2012-251099 A 12/2012
JP 2013-052506 A 3/2013
JP 2015-503232 A 1/2015
JP 2016-047566 A 4/2016
WO WO-2015/178289 A1 11/2015

* cited by examiner

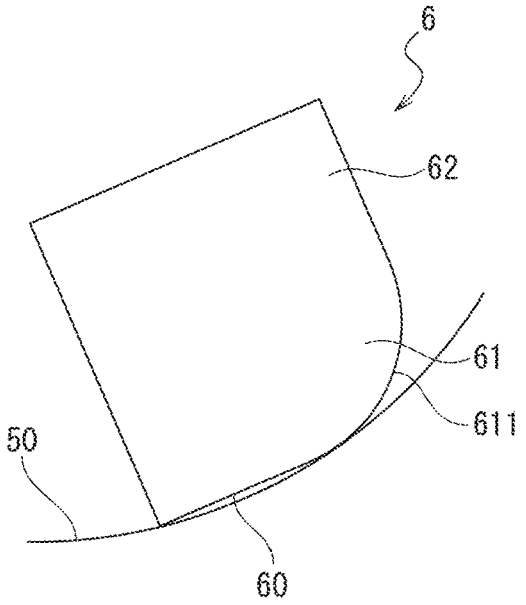
FIG. 5A
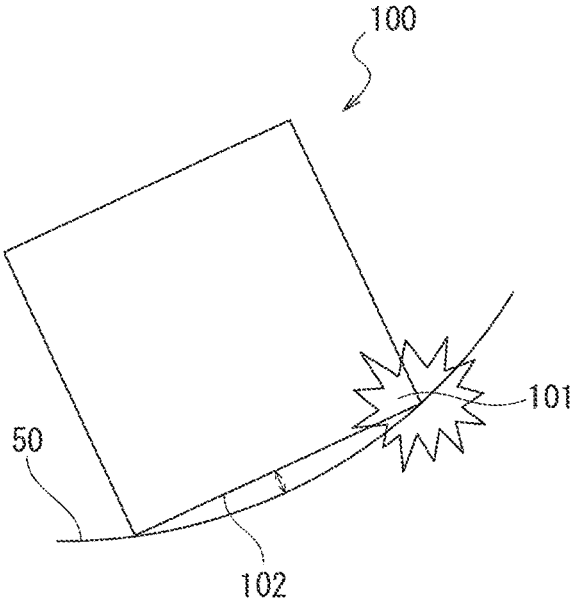
FIG. 5B
FIG. 6A
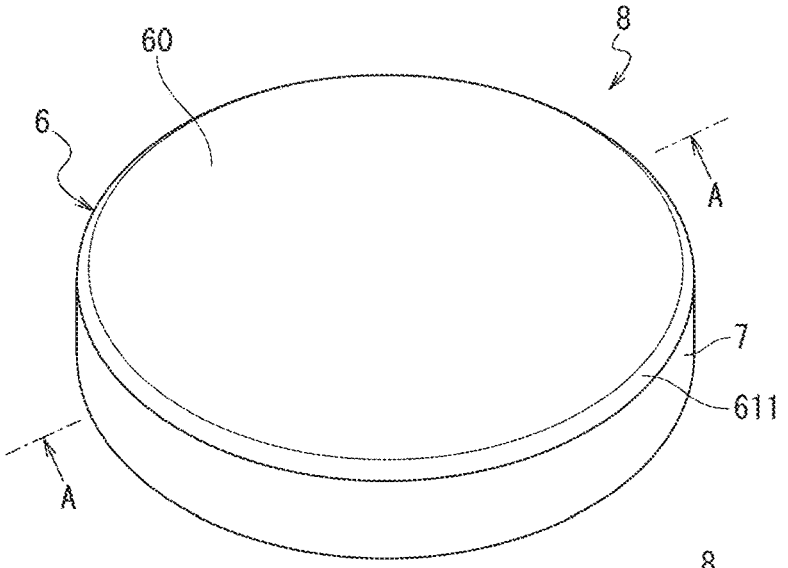
FIG. 6B
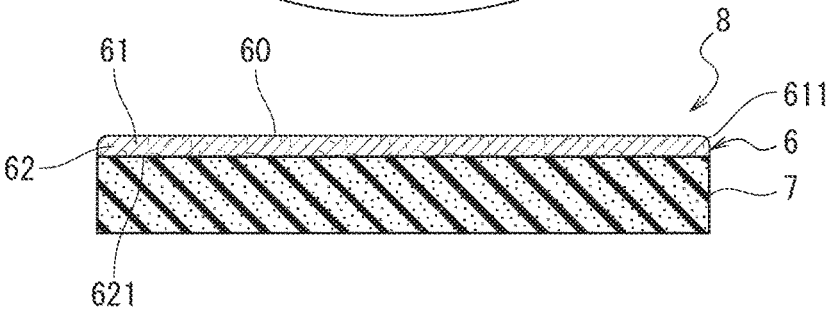

POLISHING METHOD AND POLISHING PAD

TECHNICAL FIELD

The present invention relates to a polishing method and a polishing pad.

BACKGROUND ART

There has been known a buffing process as a processing method to smooth a polished object having a curved surface, for example, a painted surface of a vehicle body such as a vehicle (for example, PTL 1). The buffing process is a method that applies various kinds of abrading agents or the like to a peripheral area (a surface) of a grinding wheel (a buff) made of any material including a cloth and rotates the grinding wheel to polish an object to be polished.

However, the buffing process cannot remove an undulation of a surface of the polished object; therefore, it was difficult to achieve beautiful surface finish.

In response to this, the inventors have proposed a polishing method that can remove an undulation of a surface of a polished object having a curved surface (see PTL 2).

CITATION LIST

Patent Literature

PTL 1: JP 2012-251099 A
PTL 2: JP 2016-47566 A

SUMMARY OF INVENTION

Technical Problem

A method of PTL 2 uses a polishing pad having a polishing surface formed of a hard resin layer; therefore, especially when a comparatively soft concave curved surface such as a coated film is polished, reducing polishing scratches becomes an object.

A first object of the present invention is to provide a polishing method that can reduce polishing scratches even when a polished surface is a comparatively soft concave curved surface such as a coated film.

Meanwhile, when polishing with polishing slurry (slurry containing abrasives) is performed using a polishing pad made of a porous material having an interconnected cell structure such as foamed polyurethane, the slurry soaks through the polishing pad and the soaked slurry disperses, and therefore the slurry is not used for polishing, causing a problem of low usage efficiency of the slurry.

A second object of the present invention is to provide a polishing pad featuring usage efficiency of slurry higher than that of the conventional product as a polishing pad used for polishing with polishing slurry.

Solution to Problem

To achieve the first object, a polishing method as a first aspect of the present invention features having the following configurations (1) to (3).

(1) A disc-shaped polishing pad is used. The polishing pad has a peripheral surface at a polishing surface side in an axial direction of the disc. The peripheral surface is a tapered surface having a diameter reduced to the polishing surface.

An angle formed by the peripheral surface at the polishing surface side and the polishing surface is 125° or more and less than 180°.

(2) The used polishing pad has hardness of 40 or more. The hardness is hardness (hereinafter referred to as "C hardness") immediately after a pressing surface is in close contact by a testing method specified in an appendix 2 of JIS K7312: 1996, "Spring Hardness Test Type C Testing Method".

This testing method uses a spring hardness testing machine having a structure that indicates a distance of an indenter protruding from a hole at a center of the pressing surface by spring pressure being pressed to return by a test specimen when the pressing surface of the testing machine is brought into close contact with a surface of the test specimen by scale as the hardness. The measured surface of the test specimen has a size at least equal to or more than the pressing surface of the testing machine.

(3) Slurry containing abrasives is supplied to a polished surface (a surface of a polished object) larger than the polishing surface. The polishing surface is pressed against the polished surface and the polishing pad is moved to polish the polished surface.

The polishing method having the configuration (3) is likely to generate a polishing scratch on the polished surface compared with a polishing method where a polished surface is smaller than a polishing surface.

To achieve the first object, a polishing method as a second aspect of the present invention features having the configurations (2) and (3) and the following configuration (4).

(4) The polishing pad has a disc shape, and a peripheral surface at the polishing surface side in an axial direction of the disc is an arc surface.

To achieve the first object, a polishing method as a third aspect of the present invention features having the following configurations (11) to (13).

(11) Slurry containing abrasives is supplied to a polished surface (a surface of a polished object).

(12) A polishing pad has hardness of 40 or more and 80 or less is used. The hardness is hardness (hereinafter referred to as "C hardness") immediately after a pressing surface is in close contact by a testing method specified in an appendix 2 of JIS K7312: 1996, "Spring Hardness Test Type C Testing Method".

This testing method uses a spring hardness testing machine having a structure that indicates a distance of an indenter protruding from a hole at a center of the pressing surface by spring pressure being pressed to return by a test specimen when the pressing surface of the testing machine is brought into close contact with a surface of the test specimen by scale as the hardness. The measured surface of the test specimen has a size at least equal to or more than the pressing surface of the testing machine.

(13) A polishing surface is pressed against the polished surface and the polishing pad is moved to polish the polished surface.

To achieve the second object, a polishing pad as a fourth aspect of the present invention features the following. The polishing pad is a polishing pad used for polishing with polishing slurry. A water stop portion is formed at a part of or an entire surface.

Advantageous Effects of Invention

According to the polishing methods of the first to the third aspects of the present invention, even when the polished surface is a comparatively soft concave curved surface such as a coated film, polishing scratches can be reduced.

According to the polishing pad of the fourth aspect of the present invention, usage efficiency of the slurry becomes higher than a conventional product in which a water stop portion is not formed.

BRIEF DESCRIPTION OF DRAWINGS

FIG. 1A is a perspective view illustrating a polishing surface side.

FIG. 2A is a schematic diagram describing polishing methods of the first embodiment and a second embodiment.

FIG. 3A is a plan view illustrating a polishing surface, and FIG. 3B is the cross-sectional view taken along A-A;

FIG. 4A is a perspective view illustrating a polishing surface side, and FIG. 4B is the cross-sectional view taken along A-A;

FIG. 5A is a schematic diagram describing polishing methods of the third embodiment and a fourth embodiment, and FIG. 5B is a schematic diagram describing a conventional polishing method;

FIGS. 6A and 6B are drawings illustrating a polishing pad used by a method of the fourth embodiment, FIG. 6A is a plan view illustrating a polishing surface, and FIG. 6B is the cross-sectional view taken along A-A;

FIG. 11A is a plan view illustrating a polishing surface, and FIG. 11B is the cross-sectional view taken along A-A;

FIG. 13A is a plan view illustrating a polishing surface, and FIG. 13B is the cross-sectional view taken along A-A;

FIG. 14A is a plan view of a polishing pad placed so as to face a polishing surface downward, and FIG. 14B is the cross-sectional view taken along A-A;

FIG. 15A is a plan view of a polishing pad placed so as to face a polishing surface downward, and FIG. 15B is the cross-sectional view taken along A-A;

FIG. 16A is a plan view of a polishing pad placed so as to face a polishing surface downward, and FIG. 16B is the cross-sectional view taken along A-A;

FIG. 17A is a plan view of a polishing pad placed so as to face a polishing surface downward, and FIG. 17B is the cross-sectional view taken along A-A;

FIG. 18A is a plan view of a polishing pad placed so as to face a polishing surface downward, and FIG. 18B is the cross-sectional view taken along A-A;

FIG. 19A is a plan view of a polishing pad placed so as to face a polishing surface downward, and FIG. 19B is the cross-sectional view taken along A-A;

FIG. 20A is a plan view of a polishing pad placed so as to face a polishing surface downward, and FIG. 20B is the cross-sectional view taken along A-A;

FIG. 21A is a plan view of a polishing pad placed so as to face a polishing surface downward, and FIG. 21B is the cross-sectional view taken along A-A;

FIG. 22A is a plan view of a polishing pad placed so as to face a polishing surface downward, and FIG. 22B is the cross-sectional view taken along A-A;

FIG. 23A is a plan view of a polishing pad placed so as to face a polishing surface downward, and FIG. 23B is the cross-sectional view taken along A-A.

DESCRIPTION OF EMBODIMENTS

While embodiments of the present invention will now be described, the present invention is not limited to the embodiments described later. While the embodiments described later are limited to be technically preferable to embody the present invention, the limitations are not requirements essential for the present invention.

First Aspect and Second Aspect

First Embodiment

The following describes a method of the first embodiment with reference to FIGS. 1A to 2B.

Figure 1A:
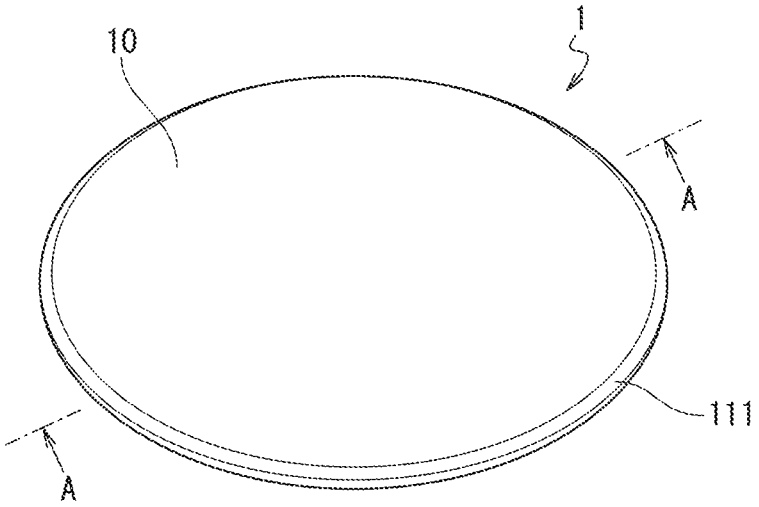
FIGS. 1A and 2A are drawings illustrating a polishing pad used by a method of a first embodiment.
Figure 1B:
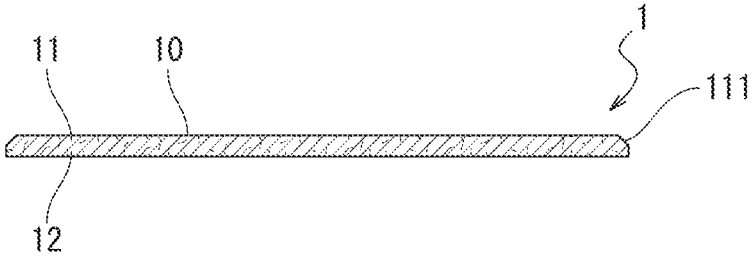
FIG. 1B is a cross-sectional view taken along A-A.

The polishing method of this embodiment uses a disc-shaped polishing pad 1 illustrated in FIGS. 1A and B.

The polishing pad 1 is a suede type or a nonwoven fabric type polishing pad and has a thickness of 0.5 mm or more and 5.0 mm or less. The hardness of the polishing pad 1 is C hardness of 40 or more and 90 or less.

The polishing pad 1 is divided into a part (an end portion) 11 on a polishing surface 10 side and a part (a base portion) 12 on a side opposite to the polishing surface 10 in an axial direction of the disc. A peripheral surface 111 of the end portion 11 is a tapered surface whose diameter is reduced to the polishing surface 10. An angle θ (see FIG. 2A) formed by the peripheral surface 111 and the polishing surface 10 is 125° or more and less than 180°. That is, a corner portion of the end portion 11 is chamfered into an inclined surface shape.

A method to chamfer the corner portion to be 125° or more and less than 180° includes a cutting method. An example of the cutting method includes a method that moves a sander or a circular cutting edge, which rotates at high speed, while pressing the sander or the circular cutting edge to the corner portion of the polishing pad, a method that cuts out the corner portion with a blade of a cutter, and a method that files the corner portion with a sandpaper.

The method also includes a method (a Thomson process) that performs a groove process on plywood and a resin plate with laser, manufactures a blade mold by embedding a steel edged tool bent into a shape identical to the groove into the groove, and presses this blade mold against the polishing pad surface for cutting.

Figure 2A:
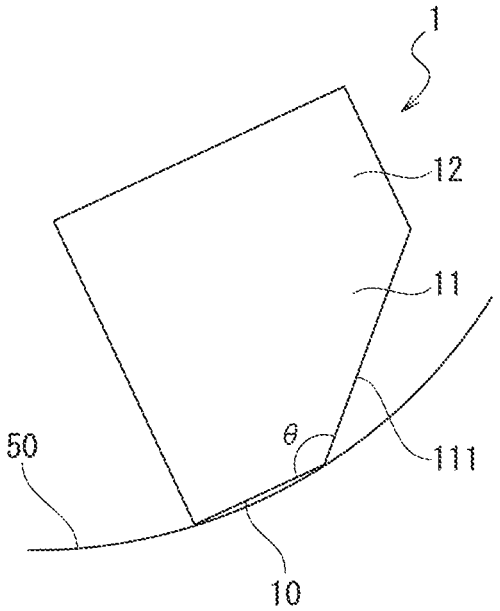

As illustrated in FIG. 2A, the polishing method of this embodiment supplies slurry containing abrasives to a polished surface 50 larger than the polishing surface 10, presses the polishing surface 10 of the polishing pad 1 against the polished surface 50, and rotates the polishing pad 1 around an axis of the disc to polish the polished surface 50. The polished surface 50 is a concave curved surface formed of a coated film made of synthetic resin.

Figure 2B:
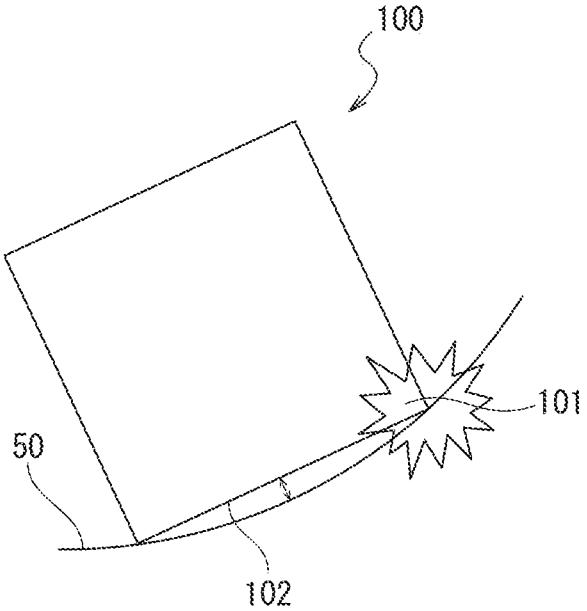
FIG. 2B is a schematic diagram describing a conventional polishing method.

The polishing method of this embodiment uses the polishing pad 1 having the tapered surface with the angle θ formed by the peripheral surface 111 of the end portion 11 and the polishing surface 10 of 125° or more and less than 180°; therefore, polishing scratches to the polished surface 50 can be reduced. In contrast to this, as illustrated in FIG. 2B, when a disc-shaped polishing pad 100 with right-angle corner portions 101 is used, the corner portion 101 contacts the polished surface 50 prior to a polishing surface 102; therefore, the polishing scratch is likely to occur in the polished surface 50.

An example of the polished surface with the concave curved surface shape includes a coated film surface of, for example, various parts and a vehicle (for example, a part made of synthetic resin, a vehicle body of the vehicle, a railway vehicle, an aircraft, a bicycle, and a ship).

Since the polishing pad 1 with the C hardness of 40 or more and 90 or less is used, an undulation of the polished surface 50 can be removed.

Second Embodiment

Figure 3A:
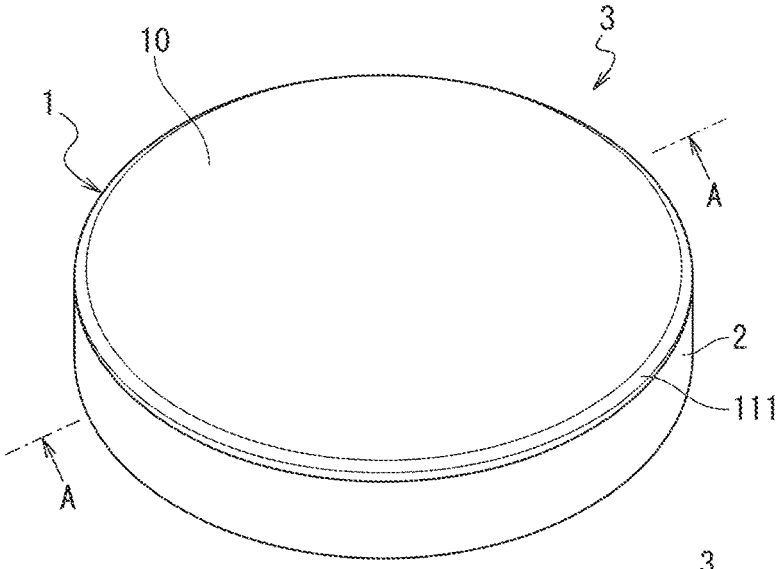
FIGS. 3A and 3B are drawings illustrating a polishing pad used by the method of the second embodiment.
Figure 3B:
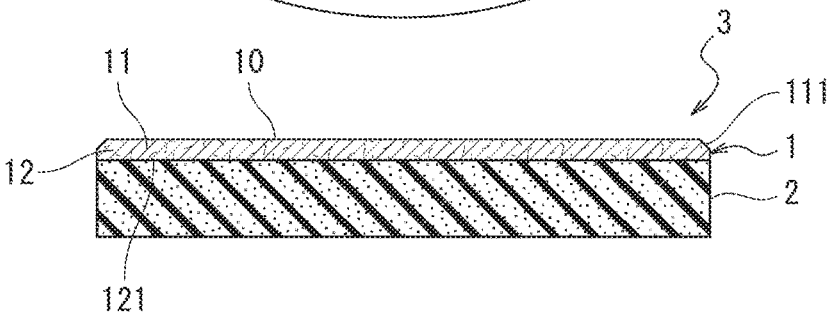

A polishing method of this embodiment uses a polishing pad with support layer 3 illustrated in FIGS. 3A and 3B.

The polishing pad with support layer 3 is constituted of the polishing pad 1 of the first embodiment and a support layer 2 made of foamed polyurethane softer than the polishing pad 1. The support layer 2 is fixed to a surface 121 on a side opposite to the polishing surface 10 of the polishing pad 1 with adhesive or a double-sided tape. The support layer 2 has a thickness of 2.0 mm or more and 50 mm or less.

The polishing method of this embodiment ensures obtaining effects identical to those of the polishing method of the first embodiment by the function of the polishing pad 1. Additionally, since the polishing pad with support layer 3 of a two-layer structure where the soft support layer 2 is fixed is used, the following effect can also be obtained.

When force given from a polishing device to the soft support layer 2 is transmitted to the polishing pad 1 and the polishing surface 10 is pressed against the polished surface 50, the soft support layer 2 easily deforms along the polished surface 50 with the concave curved surface shape. In association with this, the hard polishing pad 1 fixed to the support layer 2 also deforms similar to the support layer 2. Consequently, the polishing surface 10 is likely to follow the polished surface with the concave curved surface shape. Accordingly, compared with the polishing method of the first embodiment, the polishing method of the second embodiment has the higher effect of removing the undulation of the polished surface with the curved surface shape.

Third Embodiment

The following describes a method of the third embodiment with reference to FIGS. 4A to 5B.

Figure 4A:
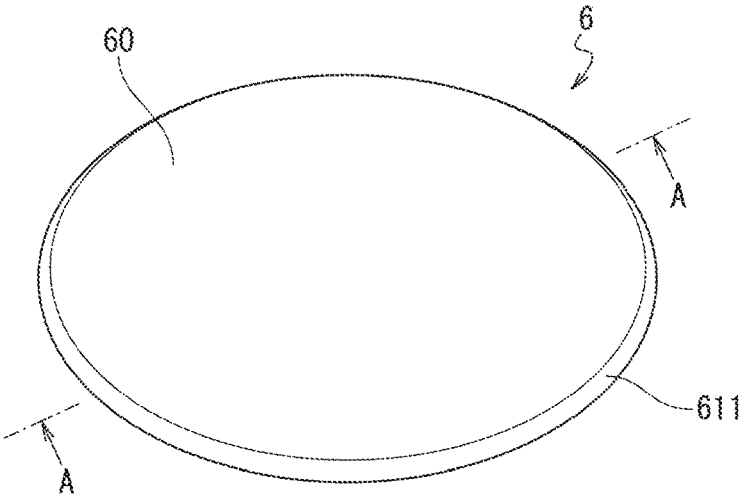
FIGS. 4A and 4B are drawings illustrating a polishing pad used by a method of a third embodiment.
Figure 4B:
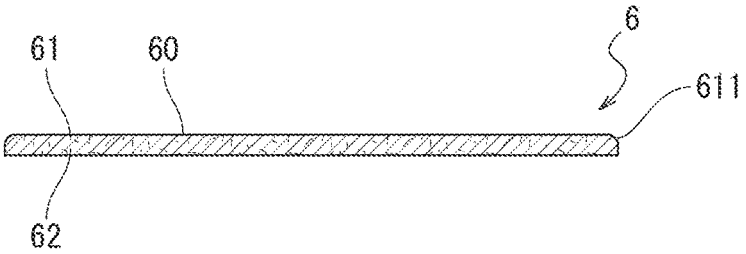

The polishing method of this embodiment uses a disc-shaped polishing pad 6 illustrated in FIGS. 4A and 4B.

The polishing pad 6 is a suede type or a nonwoven fabric type polishing pad and has a thickness of 0.5 mm or more and 5.0 mm or less. The hardness of the polishing pad 6 is C hardness of 40 or more and 90 or less.

The polishing pad 6 is divided into a part (an end portion) 61 on a polishing surface 60 side and a part (a base portion) 62 on a side opposite to the polishing surface 60 in an axial direction of the disc. A peripheral surface 611 of the end portion 61 is an arc surface. That is, a corner portion of the end portion 61 is roundly chamfered.

A method to roundly chamfer the corner portion includes a cutting method. An example of the cutting includes a method that moves a sander or a circular cutting edge, which rotates at high speed, while pressing the sander or the circular cutting edge against the corner portion of the polishing pad, a method that cuts out the corner portion with a blade of a cutter, and a method that files the corner portion with a sandpaper. The method also includes a method (a Thomson process) that performs a groove process on plywood and a resin plate with laser, manufactures a blade mold by embedding a steel edged tool bent into a shape identical to the groove into the groove, and presses this blade mold against the polishing pad surface for cutting.

As illustrated in FIG. 5A, the polishing method of this embodiment supplies slurry containing abrasives to the polished surface 50 larger than the polishing surface 60, presses the polishing surface 60 of the polishing pad 6 against the polished surface 50, and rotates the polishing pad 6 around an axis of the disc to polish the polished surface 50. The polished surface 50 is a concave curved surface formed of a coated film made of synthetic resin.

The polishing method of this embodiment uses the polishing pad 6 having the peripheral surface 611 of the end portion 61 being the arc surface; therefore, the polishing scratches to the polished surface 50 can be reduced. In contrast to this, as illustrated in FIG. 5B, when the disc-shaped polishing pad 100 with right-angle corner portions 101 is used, the corner portion 101 contacts the polished surface 50 prior to the polishing surface 102; therefore, the polishing scratch is likely to occur in the polished surface 50.

An example of the polished surface with the concave curved surface shape includes a coated film surface of, for example, various parts and a vehicle (for example, a part made of synthetic resin, a vehicle body of the vehicle, a railway vehicle, an aircraft, a bicycle, and a ship).

Since the polishing pad 6 with the C hardness of 40 or more and 90 or less is used, an undulation of the polished surface 50 can be removed.

Fourth Embodiment

A polishing method of this embodiment uses a polishing pad with support layer 8 illustrated in FIGS. 6A and 6B.

The polishing pad with support layer 8 is constituted of the polishing pad 6 of the third embodiment and a support layer 7 made of foamed polyurethane softer than the polishing pad 6. The support layer 7 is fixed to a surface 621 on a side opposite to the polishing surface 60 of the polishing pad 6 with adhesive or a double-sided tape. The support layer 7 has a thickness of 2.0 mm or more and 50 mm or less.

The polishing method of this embodiment ensures obtaining the effects identical to those of the polishing method of the first embodiment by the function of the polishing pad 6. Additionally, since the polishing pad with support layer 8 of a two-layer structure where the soft support layer 7 is fixed is used, the following effect can also be obtained.

When force given from a polishing device to the soft support layer 7 is transmitted to the polishing pad 6 and the polishing surface 60 is pressed against the polished surface 50, the soft support layer 7 easily deforms along the polished surface 50 with the concave curved surface shape. In association with this, the hard polishing pad 6 fixed to the support layer 7 also deforms similar to the support layer 7. Consequently, the polishing surface 60 is likely to follow the polished surface with the concave curved surface shape.

Accordingly, compared with the polishing method of the third embodiment, the polishing method of the fourth embodiment has the higher effect of removing the undulation of the polished surface with the curved surface shape.

<Preferable Configurations and Like of Polishing Pad Used by Polishing Methods of First and Second Aspects>

The polishing pad preferably has the thickness of 0.5 mm or more and 5.0 mm or less. The thickness in the range facilitates removing the undulation by the polishing pad and the polishing pad to which the support layer is fixed is likely to deform similar to the support layer.

The polishing surface preferably has the diameter of 10 mm or more and 200 mm or less. The diameter in the range ensures shortening a time taken for the slurry to go across from the outer edge portion to the center portion of the polishing surface and the polishing surface easily follows the polished surface with the curved surface shape.

Not only the surface made of synthetic resin, the polished surface may also be, for example, a metal surface, a silicon wafer surface, a glass surface, and a sapphire surface.

The polishing pad used only needs to have the C hardness of 40 or more and 90 or less, and includes a polishing pad manufactured made of rigid polyurethane and the like except for the suede type and the nonwoven fabric type. The polishing pad used preferably has the C hardness of 50 or more and 80 or less.

Except for foamed polyurethane, the material of the support layer includes foamed polyethylene, foamed rubber, foamed melamine, foamed silicone, and the like. The hardness of the support layer is preferably F hardness (hardness measured by "ASKER Durometer Type F" manufactured by Kobunshi Keiki Co., Ltd.) of 30 or more and 90 or less. The F hardness 90 is equivalent to less than the C hardness 10.

The ASKER Durometer Type F is a durometer having a large indenter and pressing surface such that an appropriate instruction value is obtained in especially hardness measurement of a soft specimen, and a shape of the indenter is a cylindrical shape with a height of 2.54 mm and a diameter of 25.2 mm.

<Example of Methods for Manufacturing Polishing Pad Used by Polishing Method of First and Second Aspects>

The suede type: for example, nonwoven fabric and woven fabric made of synthetic fiber, synthetic rubber, or the like or a polyester film or the like is used as the base material. Applying polyurethane-based solution on the top surface of the base material and solidifying the polyurethane-based solution using a wet coagulation method forms a skin layer of a porous layer having continuous pores. The surface of the skin layer is ground and removed as necessary.

The nonwoven fabric type: for example, polyurethane elastomer solution is impregnated into needle-punched nonwoven fabric made of polyester short fiber. The nonwoven fabric in this state is dipped into water, the wet coagulation is performed, and then the nonwoven fabric is cleaned with water and dried, and after the drying, a grinding process is performed on both surfaces. Alternatively, for example, thermosetting urethane resin solution is impregnated into the needle-punched nonwoven fabric made of polyester short fiber. By drying the nonwoven fabric in this state, after thermosetting urethane resin is fixed to the nonwoven fabric, a sanding process is performed on both surfaces to remove unevenness.

<Slurry Used by Polishing Methods of First and Second Aspects>

The abrasives contained in the slurry used by the polishing methods of the first and the second aspects of the present invention include abrasives selected from, for example, particles made of silicon such as silica, alumina, ceria, titania, zirconia, iron oxide, and manganese oxide or oxide of a metallic element, organic particles made of thermoplastic resin or organic/inorganic compound particles.

For example, the use of alumina slurry containing alumina particles allows high polishing removal rate, and the alumina slurry is easily obtainable and therefore is preferable.

There are aluminas of different crystal forms such as α-alumina, β-alumina, γ-alumina, and θ-alumina, and also an aluminum compound referred to as hydrated alumina is present. From an aspect of the polishing removal rate, the use of the slurry containing the particles mainly constituted of the α-alumina as the abrasives is more preferable.

The average particle diameter of the abrasives is preferably 0.1 μm or more and 10.0 μm or less and more preferably 0.3 μm or more and 5.0 μm or less. The larger the average particle diameter is, the more the polishing removal rate is improved. The average particle diameter within the range easily improves the polishing removal rate up to a level especially preferable for practical use. The smaller the average particle diameter is, the more the dispersion stability of the abrasives is improved, reducing scratches (scratches) of the polishing surface.

The average particle diameter within the range easily improves the dispersion stability of the abrasives and surface accuracy of the polishing surface up to a level especially preferable for practical use.

The content of the abrasives in the slurry is preferably 0.1 mass % or more and 50 mass % or less, more preferably 0.2 mass % or more and 25 mass % or less, and further preferably 0.5 mass % or more and 20 mass % or less. The larger the content of the abrasives is, the more the polishing removal rate is improved. The content of the abrasives within the range easily improves the polishing removal rate up to the level especially preferable for practical use while the cost is reduced. Surface defects on the surface of the object to be polished after the polishing can be further reduced.

In addition to the abrasives and the dispersing agent, the slurry may appropriately contain another component such as lubricating oil, organic solvent, surfactant, and thickener as necessary. The lubricating oil may be synthetic oil, mineral oil, vegetable oil, or a combination of these oils. In addition to hydrocarbon-based solvent, the organic solvent may be, for example, alcohol, ether, glycols, and glycerin. The surfactant may be so-called anionic, cationic, nonionic, or amphoteric surfactant. The thickener may be synthetic thickener, cellulosic thickener, or natural thickener.

<Polishing Pad Whose Peripheral Surface of End Portion is Formed into Two Stages in Axial Direction>

Figure 7A:
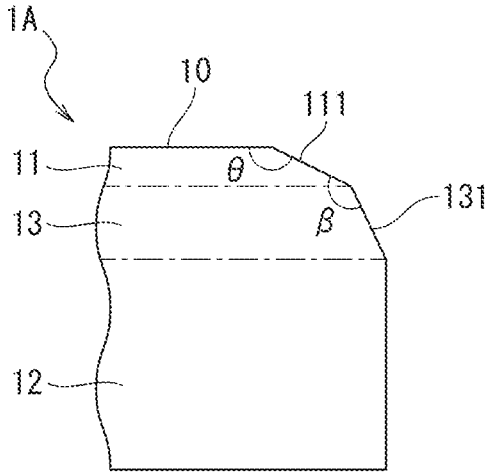
FIGS. 7A to 7C are drawings describing a polishing pad where a peripheral surface of an end portion is formed into two stages in an axial direction.

A polishing pad 1A illustrated in FIG. 7A has a disc shape and is divided into the part (the end portion) 11 on the polishing surface 10 side, the part (the base portion) 12 on the side opposite to the polishing surface 10, and a part (an intermediate portion) 13 between the end portion 11 and the base portion 12 in an axial direction of the disc. The peripheral surface 111 of the end portion 11 is a tapered surface whose diameter is reduced to the polishing surface 10. A peripheral surface 131 of the intermediate portion 13 is a tapered surface whose diameter is reduced to the polishing surface 10. An angle β formed by the peripheral surface 111 and the peripheral surface 131 is smaller than the angle θ formed by the peripheral surface 111 and the polishing surface 10.

Figure 7B:
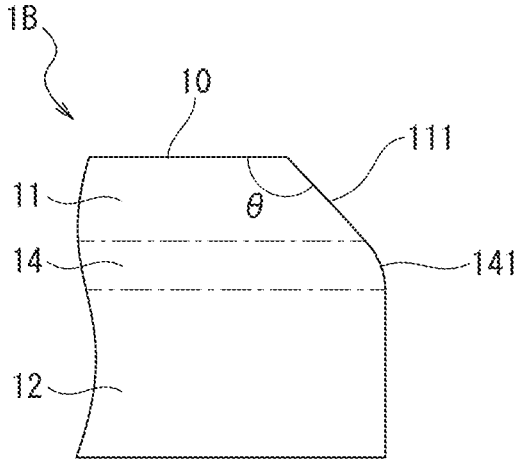

A polishing pad 1B illustrated in FIG. 7B has a disc shape and is divided into the part (the end portion) 11 on the polishing surface 10 side, the part (the base portion) 12 on the side opposite to the polishing surface 10, and a part (an intermediate portion) 14 between the end portion 11 and the base portion 12 in an axial direction of the disc. The peripheral surface 111 of the end portion 11 is a tapered surface whose diameter is reduced to the polishing surface 10. A peripheral surface 141 of the intermediate portion 14 is an arc surface.

Figure 7C:
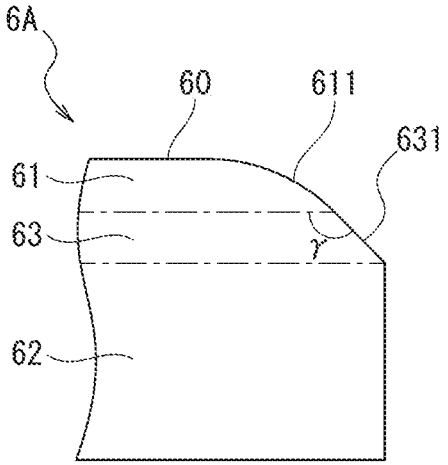

A polishing pad 6A illustrated in FIG. 7C has a disc shape and is divided into the part (the end portion) 61 on the polishing surface 60 side, the part (the base portion) 62 on the side opposite to the polishing surface 60, and a part (an intermediate portion) 63 between the end portion 61 and the base portion 62 in an axial direction of the disc. The peripheral surface 611 of the end portion 61 is an arc surface. A peripheral surface 631 of the intermediate portion 63 is a tapered surface whose diameter is reduced to the polishing surface 60. An angle γ formed by a boundary line (a line parallel to the polishing surface) between the end portion 61 and the base portion 62 and the peripheral surface 631 is an obtuse angle.

<Remarks on Polishing Methods of First and Second Aspects>

For example, when a groove is formed on the polishing surface of the polishing pad, a corner portion of a wall surface of the groove with the polishing surface may be chamfered or may be formed into an arc surface. In the case where a hole axially extending at the center of the polishing pad is disposed, the corner portion of the wall surface of the hole with the polishing surface may be chamfered or may be formed into an arc surface.

[Polishing Device Usable by Polishing Methods of First and Second Aspects]

The polishing methods of the first and the second aspects feature the polishing pads used. As long as this polishing pad is mountable, the polishing surface can be pressed against the polished surface larger than the polishing surface, and the polishing pad can be moved, any polishing device is applicable. An automatic polishing device 400 illustrated in FIG. 24 is one example of a polishing device usable by the polishing methods of the first and the second aspects.

Figure 24:
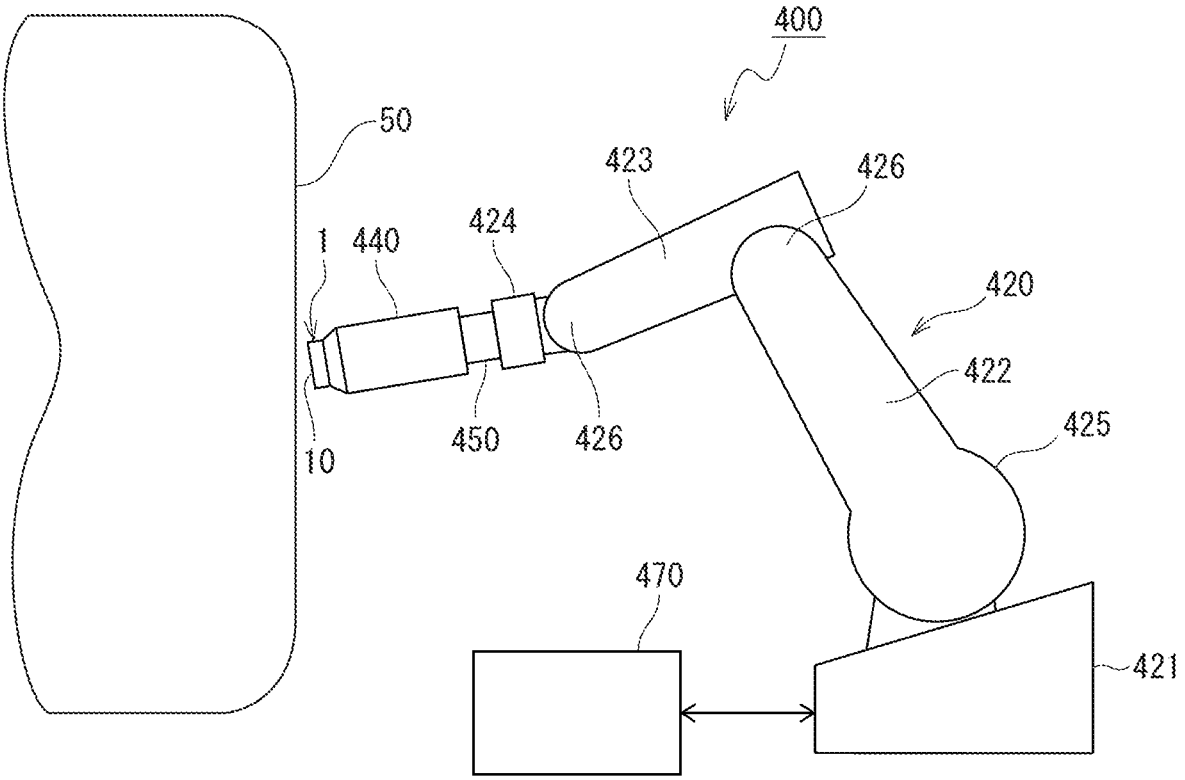
FIG. 24 is a schematic configuration diagram illustrating one example of a polishing device usable for each aspect of the present invention.

The automatic polishing device 400 illustrated in FIG. 24 includes a robot arm 420, the polishing pad 1, a polishing tool 440, a pressing force detector 450, and a controller 470. The robot arm 420 includes a foundation portion 421, a plurality of arm portions 422 and 423, a distal end portion 424, and a plurality of joints 425, 426, and 427. The plurality of joints 425, 426, and 427 allow the distal end portion 424 to move in a plurality of directions. The pressing force detector 450 and the polishing tool 440 are mounted to the distal end portion 424 in this order. The polishing pad 1 is mounted to the distal end of the polishing tool 440 for use of the automatic polishing device 400.

Driving means built into the polishing tool 440 rotates the polishing pad 1 with a direction perpendicular to the polishing surface 10 of the polishing pad 1 as the rotation axis. Although the driving means of the polishing tool 440 is not specifically limited, for example, a single action, a double action, and a gear action are generally used, and the double action is preferable for polishing of a painted part. The controller 470 controls the behavior of the robot arm 420 and the rotation of the polishing pad 1 by the polishing tool 440.

The pressing force detector 450 detects pressing force of the polishing surface 10 of the polishing pad 1 against the polished surface 50. The controller 470 controls the robot arm 420 such that the polishing pad 1 moves on the polished surface 50, for example, while the pressing force of the polishing surface 10 against the polished surface 50 is adjusted based on the detection result of the pressing force by the pressing force detector 450 or the pressing force of the polishing surface 10 against the polished surface 50 is remained to be constant.

To start the polishing, simultaneously with the driving of the automatic polishing device 400, a polishing slurry supply mechanism (not illustrated) supplies the polished surface 50 with the polishing slurry. By driving the automatic polishing device 400, the robot arm 420 presses the polishing surface 10 of the polishing pad 1 against the polished surface 50 by the control by the controller 470, thus rotating the polishing pad 1.

Another example of the polishing device usable by the polishing methods of the first and the second aspects includes a hand polisher. In this case, the polishing pads used by the polishing methods of the first and the second aspects are mounted to the distal end of the hand polisher, and worker in charge of polishing manually moves the hand polisher to polish the polished surface. Although driving means of the hand polisher is not specifically limited, for example, a single action, a double action, and a gear action are generally used, and the double action is preferable for polishing of a painted part.

Third Aspect

A polishing method of the third aspect supplies the slurry containing the abrasives to the polished surface, presses the polishing surface against the polished surface, and moves the polishing pad. In the polishing method of polishing the polished surface, the use of the polishing pad with the C hardness of 40 or more and 80 or less ensures removing the undulation of the polished surface.

With the polishing pad at the hardness, if a groove is absent on the polishing surface, it takes time for the slurry to go across to the center portion of the polishing surface when the slurry is supplied to the outside of the polished surface to which the polishing surface is pressed, having a possibility of moving the polishing pad in a state of insufficient slurry supply. Additionally, if a contaminant enters between the polishing surface and the polished surface, this contaminant is less likely to be discharged. Note that the contaminant includes a matter (a matter originated from the slurry, the polished surface, and the polishing pad) generated by the polishing, in addition to a matter mixed from the outside.

With the polishing pad at the hardness, it is estimated that the polishing scratch is likely to occur in the polished surface by the polishing surface absent of the groove due to the above-described reason.

In contrast to this, by disposing the groove on the polishing surface, when the slurry is supplied to the outside of the polished surface to which the polishing surface is pressed, the slurry is likely to go across up to the center portion of the polishing surface along this groove. Additionally, when the contaminant enters between the polishing surface and the polished surface, this contaminant is likely to be discharged along the groove. Accordingly, even when the polished surface is a comparatively soft surface such as a coated film, the polishing scratch can be prevented.

The following fifth and sixth embodiments are equivalent to the embodiment of the third aspect.

Fifth Embodiment

Figure 11A:
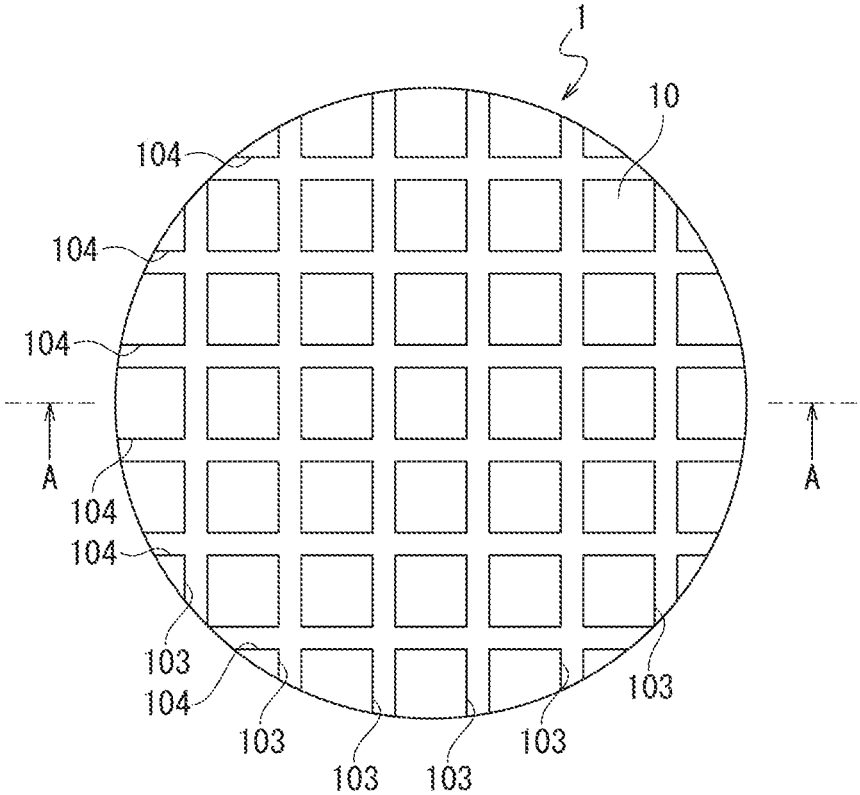
FIGS. 11A and 11B are drawings illustrating a polishing pad used by a method of a fifth embodiment.
Figure 11B:
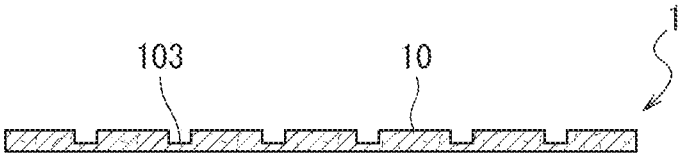

As illustrated in FIGS. 11A and 11B, the polishing method of this embodiment uses the polishing pad 1 having a grid-like groove on the polishing surface 10.

The polishing pad 1 is a suede type or a nonwoven fabric type polishing pad and has a thickness of 0.5 mm or more and 5.0 mm or less. The hardness of the polishing pad 1 is the C hardness of 40 or more and 80 or less. The polishing pad 1 is obtained by, for example, manufacturing the suede type or the nonwoven fabric type polishing pad at the hardness and then forming the grid-like groove on the polishing surface.

The grid-like groove is formed of a plurality of first grooves 103 and second grooves 104 orthogonal to one another. The method of forming this groove includes, for example, a method of removing a material of a part becoming the groove by etching and cutting. The method of removal by the cutting includes a method of moving a circular cutting edge rotated at a high speed while pressing the circular cutting edge against the polishing pad surface.

Figure 12:
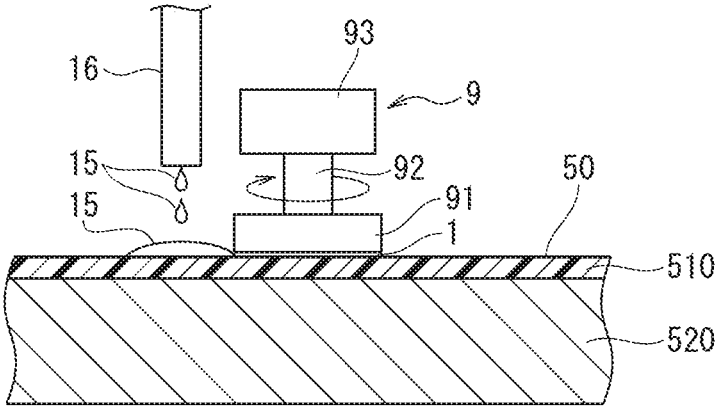
FIG. 12 is a schematic diagram describing the method of the fifth embodiment.

As illustrated in FIG. 12, the polishing method of this embodiment supplies slurry 15 containing abrasives to the polished surface 50, presses the polishing surface of the polishing pad 1 against the polished surface 50, and rotates the polishing pad 1 to polish the polished surface 50. A polisher 9 in FIG. 12 includes a base portion 91 to which the polishing pad 1 is mounted, a rotation shaft 92 fixed to the base portion 91, and a main body 93 that houses a rotation mechanism of the rotation shaft 92 and the like. The slurry 15 is supplied from a slurry supply device 16 to the polished surface 50.

The polished surface 50 is an outer surface of a coated film 510 made of synthetic resin, and the coated film 510 is formed on a surface of an object 520 such as a metallic vehicle body.

With the polishing method of this embodiment, the slurry 15 supplied to the outside of the polished surface 50 to which the polishing surface 10 is pressed is likely to go across up to the center portion of the polishing surface 10 along the grid-like groove. Additionally, if the contaminant enters between the polishing surface 10 and the polished surface 50, this contaminant is likely to be discharged along the grid-like groove. Therefore, compared with the method of using the polishing pad different from the polishing pad 1 only in that the groove is absent, this method is less likely to generate the polishing scratch in the polished surface 50 as the outer surface of the coated film 510 made of synthetic resin.

Since the polishing pad 1 with the C hardness of 40 or more and 80 or less is used, the undulation of the polished surface 50 can be removed.

Sixth Embodiment

Figure 13A:
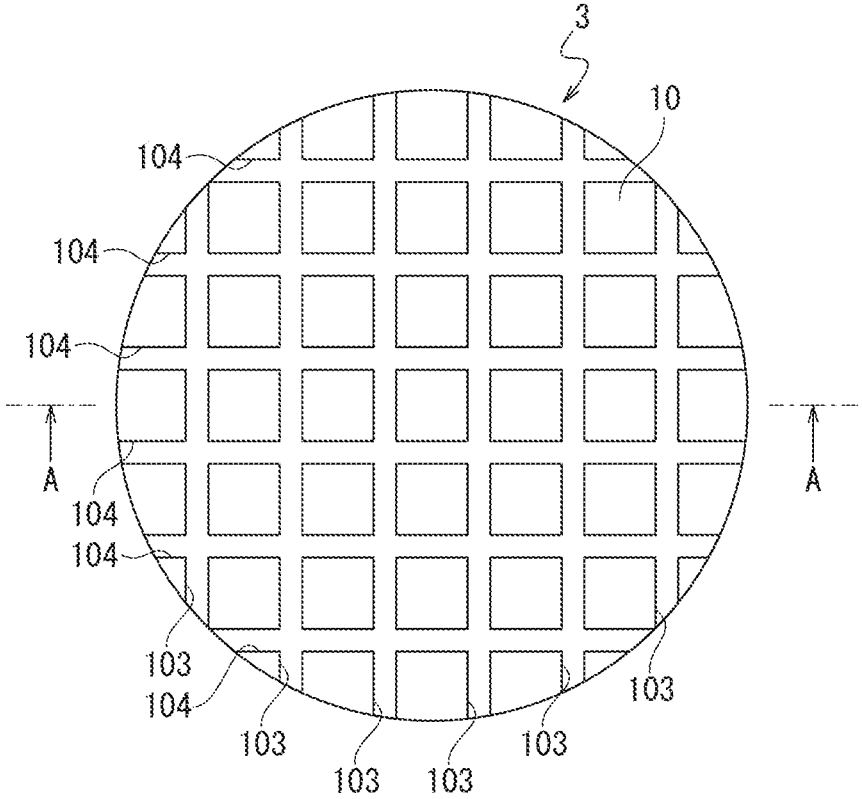
FIGS. 13A and 13B are drawings illustrating a polishing pad used by a method of a sixth embodiment.
Figure 13B:
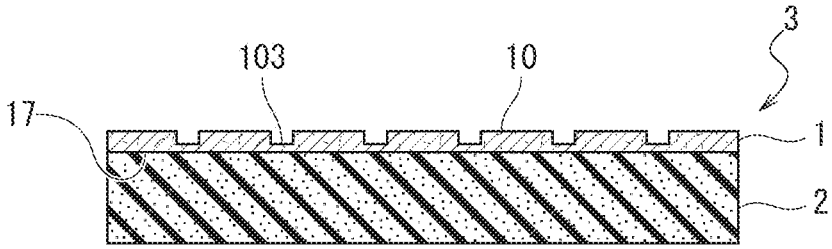

A polishing method of this embodiment uses the polishing pad with support layer 3 illustrated in FIGS. 13A and 13B.

The polishing pad with support layer 3 is constituted of the polishing pad 1 of the first embodiment and the support layer 2 made of foamed polyurethane softer than the polishing pad 1. The support layer 2 is fixed to a surface 17 on a side opposite to the polishing surface 10 of the polishing pad 1 with adhesive or a double-sided tape. The support layer 2 has a thickness of 2.0 mm or more and 50 mm or less.

With the polishing method of this embodiment, the polishing pad with support layer 3 is mounted to the polisher 9 illustrated in FIG. 12 instead of the polishing pad 1 to polish the polished surface 50 similar to the polishing method of the first embodiment.

The polishing method of this embodiment ensures obtaining the effects identical to those of the polishing method of the first embodiment by the function of the polishing pad 1. Additionally, since the polishing pad with support layer 3 of a two-layer structure where the soft support layer 2 is fixed is used, the following effect can also be obtained.

Force given from the base portion 91 to the soft support layer 2 is transmitted to the polishing pad 1, and the polishing surface 10 is pressed against the polished surface 50. When the polished surface 50 is a curved surface, the soft support layer 2 easily deforms along the curved surface. In association with this, the hard polishing pad 1 fixed to the support layer 2 also deforms similar to the support layer 2. Consequently, the polishing surface 10 follows the polished surface with the curved surface shape.

Accordingly, compared with the polishing method of the fifth embodiment, the polishing method of the sixth embodiment has the higher effect of removing the undulation of the polished surface with the curved surface shape. An example of the polished surface with the curved surface shape includes a coated film surface of a vehicle body such as a vehicle.

<Preferable Configuration and Like of Polishing Pad Used by Polishing Method of Third Aspect>

The groove of the polishing surface preferably has the width of 0.5 mm or more and 5.0 mm or less. The width in the range easily discharges a contaminant or the like attached to the polished surface. A pitch of the grooves is preferably 3.0 mm or more and 50 mm or less. The pitch in the range easily removes the undulation of the polished surface. The groove preferably has a depth 90% or less of the thickness of the polishing pad from the aspect of strength.

The planar shape of the groove of the polishing surface includes, for example, a banded shape, a radial shape, and a concentric shape in addition to the grid-like shape. The shape may be a combination of these shapes.

The polishing pad preferably has the thickness of 0.5 mm or more and 5.0 mm or less. The thickness in the range facilitates removing the undulation by the polishing pad and the polishing pad to which the support layer is fixed is likely to deform similar to the support layer.

The polishing surface preferably has the diameter of 10 mm or more and 200 mm or less. The diameter in the range ensures shortening a time taken for the slurry to go across from the outer edge portion to the center portion of the polishing surface and the polishing surface easily follows the polished surface with the curved surface shape.

The polishing method of the aspect of the present invention is preferable for an application of the polishing surface smaller than the polished surface.

Not only the surface made of synthetic resin, the polished surface may also be, for example, a metal surface, a silicon wafer surface, a glass surface, and a sapphire surface.

The polishing pad used only needs to have the C hardness of 40 or more and 80 or less, and includes a polishing pad manufactured made of rigid polyurethane and the like except for the suede type and the nonwoven fabric type. The polishing pad used preferably has the C hardness of 50 or more and 80 or less.

Except for foamed polyurethane, the material of the support layer includes foamed polyethylene, foamed rubber, melamine foam, foamed silicone, and the like. The hardness of the support layer is preferably the F hardness (hardness measured by the "ASKER Durometer Type F" manufactured by Kobunshi Keiki Co., Ltd.) of 30 or more and 90 or less. The F hardness 90 is equivalent to less than the C hardness 10.

The ASKER Durometer Type F is a durometer having a large indenter and pressing surface such that an appropriate instruction value is obtained in especially hardness measurement of a soft specimen, and a shape of the indenter is a cylindrical shape with a height of 2.54 mm and a diameter of 25.2 mm.

<Example of Method for Manufacturing Polishing Pad Used by Polishing Method of Third Aspect>

The suede type: for example, nonwoven fabric and woven fabric made of synthetic fiber, synthetic rubber, or the like or a polyester film or the like is used as the base material. Applying polyurethane-based solution on the top surface of the base material and solidifying the polyurethane-based solution by wet coagulation method forms a skin layer of a porous layer having continuous pores. The surface of the skin layer is ground and removed as necessary.

The nonwoven fabric type: for example, polyurethane elastomer solution is impregnated into needle-punched nonwoven fabric made of polyester short fiber. The nonwoven fabric in this state is dipped into water, the wet coagulation is performed, and then the nonwoven fabric is cleaned with water and dried, and after the drying, a grinding process is performed on both surfaces. Alternatively, for example, thermosetting urethane resin solution is impregnated into the needle-punched nonwoven fabric made of polyester short fiber. By drying the nonwoven fabric in this state, after thermosetting urethane resin is fixed to the nonwoven fabric, a sanding process is performed on both surfaces to remove unevenness.

<Slurry Used by Polishing Method of Third Aspect>

The abrasives contained in the slurry used by the polishing method of the third aspect of the present invention include abrasives selected from, for example, particles made of silicon such as silica, alumina, ceria, titania, zirconia, iron oxide, and manganese oxide or oxide of a metallic element, organic particles made of thermoplastic resin or organic/inorganic compound particles.

For example, the use of alumina slurry containing alumina particles allows high polishing removal rate, and the alumina slurry is easily obtainable and therefore is preferable.

There are aluminas of different crystal forms such as α-alumina, β-alumina, γ-alumina, and θ-alumina, and also an aluminum compound referred to as hydrated alumina is present. From an aspect of the polishing removal rate, the use of the slurry containing the particles mainly constituted of the α-alumina as the abrasives is more preferable.

The average particle diameter of the abrasives is preferably 0.1 μm or more and 10.0 μm or less and more preferably 0.3 μm or more and 5.0 μm or less. The larger the average particle diameter is, the more the polishing removal rate is improved. The average particle diameter within the range easily improves the polishing removal rate up to a level especially preferable for practical use. The smaller the average particle diameter is, the more the dispersion stability of the abrasives is improved, reducing scratches of the polishing surface.

The average particle diameter within the range easily improves the dispersion stability of the abrasives and surface accuracy of the polishing surface up to a level especially preferable for practical use.

The content of the abrasives in the slurry is preferably 0.1 mass % or more and 50 mass % or less, more preferably 0.2 mass % or more and 25 mass % or less, and further preferably 0.5 mass % or more and 20 mass % or less. The larger the content of the abrasives is, the more the polishing removal rate is improved. The content of the abrasives within the range easily improves the polishing removal rate up to the level especially preferable for practical use while the cost is reduced. Surface defects on the surface of the object to be polished after the polishing can be further reduced.

In addition to the abrasives and the dispersing agent, the slurry may appropriately contain another component such as lubricating oil, organic solvent, surfactant, and thickener as necessary. The lubricating oil may be synthetic oil, mineral oil, vegetable oil, or a combination of these oils. In addition to hydrocarbon-based solvent, the organic solvent may be, for example, alcohol, ether, glycols, and glycerin. The surfactant may be so-called anionic, cationic, nonionic, or amphoteric surfactant. The thickener may be synthetic thickener, cellulosic thickener, or natural thickener.

[Polishing Device Usable by Polishing Method of Third Aspect]

The polishing method of the third aspect features the polishing pads used. As long as this polishing pad is mountable and the polishing surface can be pressed against the polished surface and the polishing pad can be moved, any polishing device is applicable. The example of the polishing device includes the polisher 9 illustrated in FIG. 12, the automatic polishing device 400 illustrated in FIG. 24, and the hand polisher described above.

Fourth Aspect

A polishing pad of the fourth aspect is a polishing pad used by the polishing with polishing slurry and features formation of a water stop portion at a part of or the entire surface. The water stop portion is a part to prevent the polishing slurry from entering the polishing pad. For example, the water stop portion is formed of a material (a water stop material) less likely to penetrate the polishing slurry or formed of a raw material (a water stop raw material) having a structure less likely to penetrate the polishing slurry.

The polishing pad of the fourth aspect includes a configuration in which a part of or the entire polishing surface becomes the water stop portion. In this case, the water stop portion is configured such that a part serving as the polishing surface of the water stop portion can provide a polishing function.

One example of the polishing with the polishing slurry includes a polishing method that supplies the polishing slurry to the polished surface and moves the polishing surface of the polishing pad while pressing the polishing surface against the polished surface.

With the polishing pad of the fourth aspect, the polishing slurry is less likely to soak through the polishing pad compared with the polishing pad in which the water stop portion is not formed at a part of or the entire surface.

The polishing pad of the fourth aspect includes the following polishing pads (22) to (28).

The polishing pad (22) is the polishing pad of the fourth aspect that includes the polishing layer and the support layer formed on the surface opposite to the polishing surface of the polishing layer. The support layer is the water stop portion. With the polishing pad (22), since the support layer is the water stop portion, the polishing slurry is less likely to soak through the support layer of the polishing pad during the polishing compared with the polishing pad where the support layer is made of a porous material having an interconnected cell structure such as foamed polyurethane.

The polishing pad (23) is the polishing pad of the fourth aspect that includes an interconnected cell layer made of a porous material having an interconnected cell structure. The water stop portion is formed on a surface other than the polishing surface of the interconnected cell layer. In the case where the polishing pad (23) has a single layer, the polishing layer is the interconnected cell layer, and in the case where the polishing pad (23) has a two-layer structure, the support layer is the interconnected cell layer.

The polishing pad (24) is the polishing pad (23) that forms the water stop portion at a side surface of the interconnected cell layer.

The polishing pad (25) is the polishing pad (23) that has a through-hole. The through-hole extends in a direction intersecting with the polishing surface and penetrates the interconnected cell layer. The water stop portion is formed at a wall surface of the through-hole. The through-hole penetrating the interconnected cell layer is, for example, formed to supply the polishing slurry from a side opposite to the polishing surface of the polishing pad to the polished surface.

The polishing pad (26) is the polishing pad (23) that includes the polishing layer and the support layer formed on a surface opposite to the polishing surface of the polishing layer. The support layer is the interconnected cell layer.

The polishing pad (27) is the polishing pad (26) that includes a first through-hole and a second through-hole. The first through-hole extends in a direction intersecting with the polishing surface to penetrate the polishing layer. The second through-hole extends in the direction intersecting with the polishing surface. The second through-hole penetrates the support layer and is continuous with the first through-hole. The water stop portion is formed at a wall surface of the second through-hole.

The polishing pad (28) is the polishing pad (22), (26), or (27) where the polishing layer is made of a material harder than the support layer.

The following seventh to twelfth embodiments are equivalent to the embodiment of the fourth aspect.

Seventh Embodiment

Figure 14A:
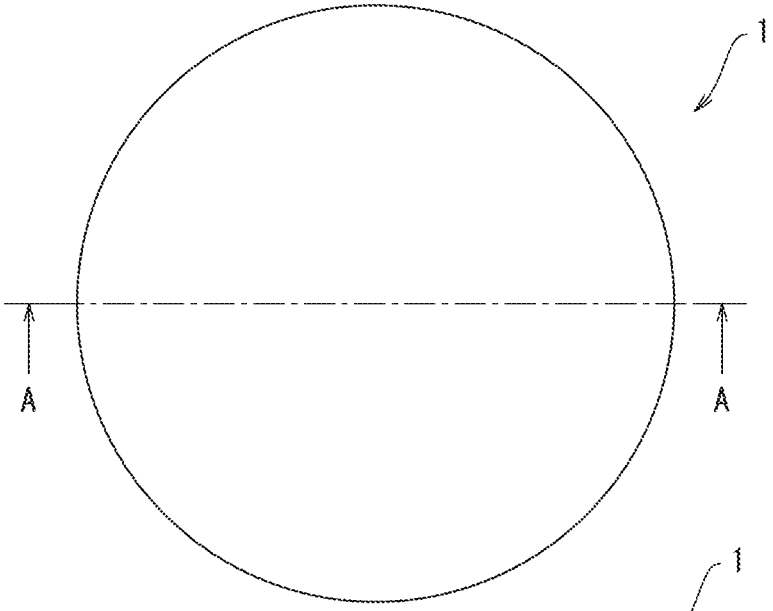
FIGS. 14A and 14B are drawings illustrating a polishing pad of a seventh embodiment.
Figure 14B:
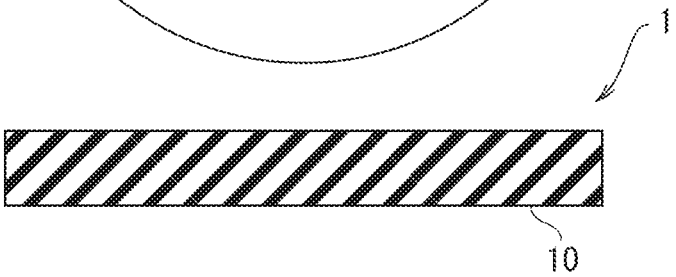

As illustrated in FIGS. 14A and 14B, the polishing pad 1 of the seventh embodiment has a disc shape and is formed of foamed rubber of a porous material having a non-interconnected cell structure. The polishing pad 1 is obtained by cutting a plate-shaped material of the foamed rubber as the porous material having the non-interconnected cell structure into the disc shape. The method of cutting into the disc shape includes a method of punching the plate-shaped material using a Thomson die with a cylindrical blade.

The polishing pad 1 has a thickness of 2.0 mm or more and 50 mm or less. The water absorption rate of the polishing pad 1 measured by the method described below is 5% or less. That is, the polishing pad 1 is made of the water stop raw material and the water stop portion is formed on the entire surface.

<Measuring Method of Water Absorption Rate>

First, a plate-piece-shaped sample of 50 mm×50 mm×10 mm in thickness is prepared to measure the weight of this sample. Next, a container into which this sample is put is prepared, and pure water is put in this container. After that, the sample is sunk such that the entire sample is dipped into the pure water and is left still for 24 hours. Next, the sample is taken out from the inside of the container, and the weight of the sample is measured after roughly wiping the pure water attached to the surface with a dry cloth.

A weight (W1: g) of the sample before being dipped into the pure water and a weight (W2: g) of the sample after the dipping and the process with the dry cloth is performed are assigned for the following Formula (1) to calculate a water absorption rate (C).

$$\text{Water absorption rate (\%)}=((W2-W1)/25)\times 100 \qquad \text{Formula (1)}$$

"25" in Formula (1) is a volume ($cm^3$) of the sample, and an amount of water absorption ($g/cm^3$) in 1 $cm^3$ of the sample is calculated as "water absorption rate" by Formula (1).

The polishing pad 1 of this embodiment is used by the polishing method with the polishing slurry. For example, a polished surface larger than the polishing surface 10 is polished using the polishing pad 1. Specifically, the polishing slurry is supplied to the polished surface, the polishing surface 10 of the polishing pad 1 is pressed against the polished surface, and the polishing pad 1 is rotated around the axis of the disc.

When this polishing method is performed using the polishing pad made of foamed polyurethane, the slurry soaks through the polishing pad and this soaked slurry disperses into the outside. The dispersed slurry is not used for polishing. In contrast to this, with the use of the polishing pad 1 of this embodiment, since the slurry is less likely to soak through the polishing pad 1 made of the water stop raw material, the amount of slurry dispersed into the outside is reduced. Accordingly, usage efficiency of the slurry becomes high.

Eighth Embodiment

Figure 15A:
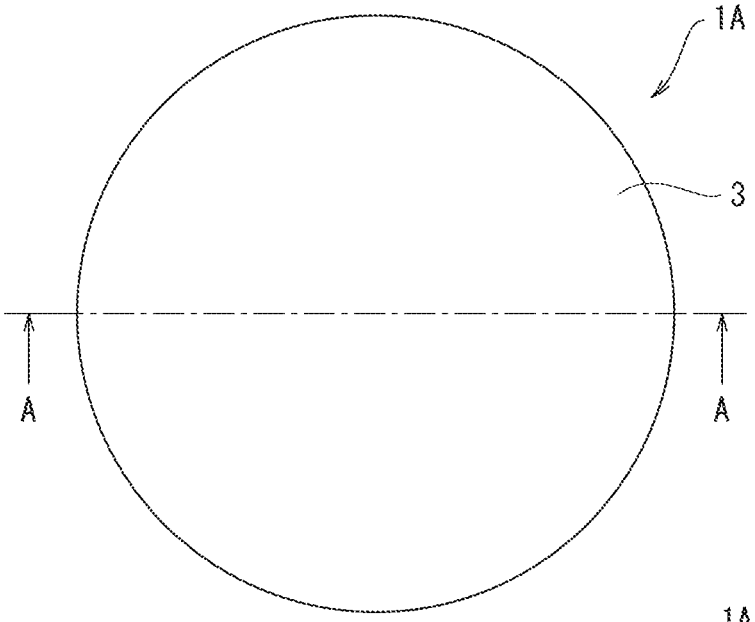
FIGS. 15A and 15B are drawings illustrating a polishing pad of an eighth embodiment.
Figure 15B:
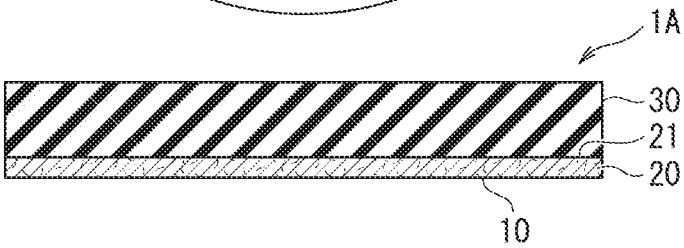

As illustrated in FIGS. 15A and 15B, the polishing pad 1A of the eighth embodiment includes a disc-shaped polishing layer 20 having the polishing surface 10 and a disc-shaped support layer 30. The support layer 30 is fixed to an opposite surface 21 to the polishing surface 10 of the polishing layer 20 with adhesive or a double-sided tape.

The polishing layer 20 is a suede type or a nonwoven fabric type polishing pad. The support layer 30 is formed of foamed rubber with a non-interconnected cell structure. The water absorption rate of the support layer 30 measured by the above-described method is 5% or less. That is, the support layer 30 is made of the water stop raw material, and a water stop portion is formed at a part of the surface of the polishing pad 1A.

The polishing layer 20 has the thickness of 0.5 mm or more and 5.0 mm or less. The support layer 30 has the thickness of 2.0 mm or more and 50 mm or less.

The polishing pad 1A can be obtained by, for example, the following method.

The suede type or the nonwoven fabric type polishing pad is cut into the disc shape to obtain the polishing layer 20.

The support layer 30 is obtained by cutting a plate-shaped material of the foamed rubber as the porous material having the non-interconnected cell structure into the disc shape. The method of cutting into the disc shape includes a method of punching the plate-shaped material using a Thomson die with a cylindrical blade. The support layer 30 is pasted to the opposite surface 21 to the polishing surface 10 of the polishing layer 20 with adhesive or a double-sided tape.

The polishing pad 1A of this embodiment is used by the polishing method with the polishing slurry. For example, the polished surface larger than the polishing surface 10 is polished using the polishing pad 1A. Specifically, the polishing slurry is supplied to the polished surface, the polishing surface 10 of the polishing pad 1A is pressed against the polished surface, and the polishing pad 1 is rotated around the axis of the disc.

When this polishing method is performed using the polishing pad where the support layer 30 of the polishing pad 1A is replaced by the support layer made of foamed polyurethane, the slurry soaks through the support layer of the polishing pad and this soaked slurry disperses into the outside. The dispersed slurry is not used for polishing. In contrast to this, with the use of the polishing pad 1A of this embodiment, since the slurry is less likely to soak through the support layer 30 made of the water stop raw material, the amount of slurry dispersed into the outside is reduced. Accordingly, usage efficiency of the slurry becomes high.

Ninth Embodiment

Figure 16A:
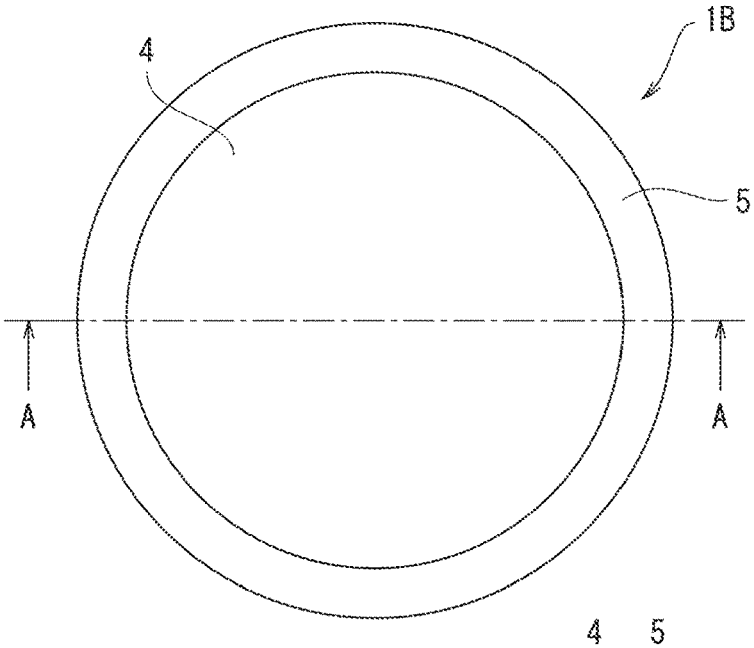
FIGS. 16A and 16B are drawings illustrating a polishing pad of a ninth embodiment.
Figure 16B:
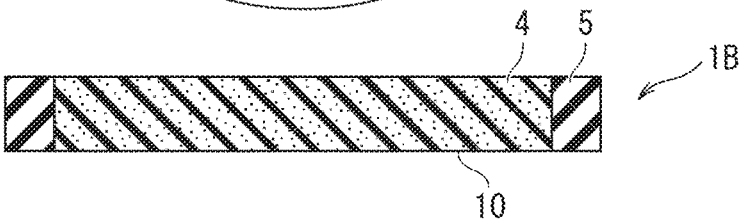

As illustrated in FIGS. 16A and 16B, the polishing pad 1B of the ninth embodiment includes a disc-shaped main body 4 and a water stop portion 5 formed on the outer peripheral surface. The main body 4 is made of foamed polyurethane (a porous material having an interconnected cell structure). The water stop portion 5 is made of foamed rubber (a porous material having a non-interconnected cell structure). The water absorption rate of the water stop portion 5 measured by the above-described method is 5% or less. That is, the main body 4 is an interconnected cell layer, and the water stop portion 5 is formed at a part of the surface except for the polishing surface 10 of the interconnected cell layer.

The thickness of the polishing pad 1B, that is, the thickness of the main body 4 and a dimension in the axial direction of the water stop portion 5 is 2.0 mm or more and 50 mm or less.

The polishing pad 1B can be obtained by, for example, the following method.

The main body 4 is obtained by a method of punching a plate-shaped material made of foamed polyurethane into a disc shape using the Thomson die having a cylindrical blade. The water stop portion 5 is obtained by a method of punching a plate-shaped material made of foamed rubber into an annular shape using a Thomson die having two cylindrical blades of different diameters. The main body 4 where adhesive is attached to the outer peripheral surface is fitted to the inner peripheral surface of the water stop portion 5 and the adhesive is hardened.

The polishing pad 1B of this embodiment is used by the polishing method with the polishing slurry. For example, the polished surface larger than the polishing surface 10 is polished using the polishing pad 1B. Specifically, the polishing slurry is supplied to the polished surface, the polishing surface 10 of the polishing pad 1B is pressed against the polished surface, and the polishing pad 1B is rotated around the axis of the disc.

When this polishing method is performed using the polishing pad made of foamed polyurethane and absent of the water stop portion 5, the slurry present at the outside of the polishing pad soaks through the polishing pad from the outer peripheral portion of the polishing pad and this soaked slurry disperses into the outside. The dispersed slurry is not used for polishing. In contrast to this, with the use of the polishing pad 1B of this embodiment, since the slurry is less likely to soak through from the outer peripheral portion to the main body 4 made of foamed polyurethane because of the formation of the water stop portion 5 on the outer peripheral surface, the amount of slurry dispersed into the outside is reduced. Accordingly, usage efficiency of the slurry becomes high.

Tenth Embodiment

Figure 17A:
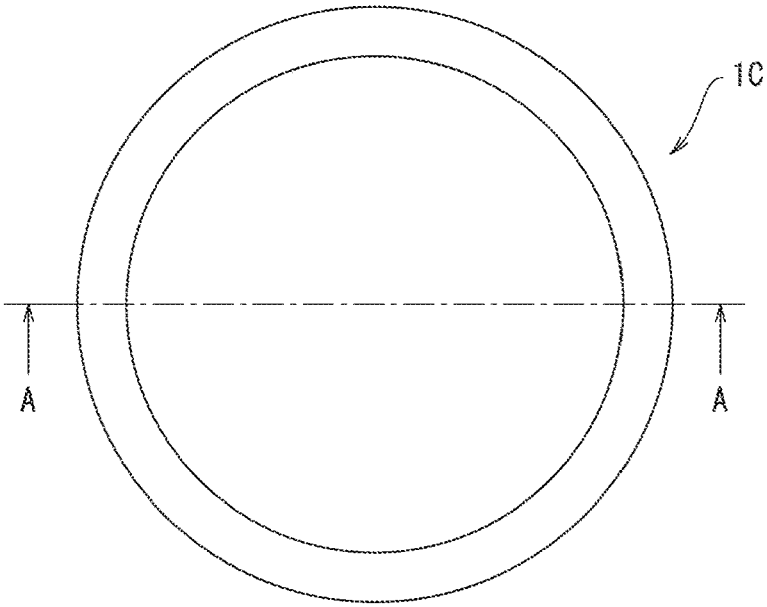
FIGS. 17A and 17B are drawings illustrating a polishing pad of a tenth embodiment.
Figure 17B:
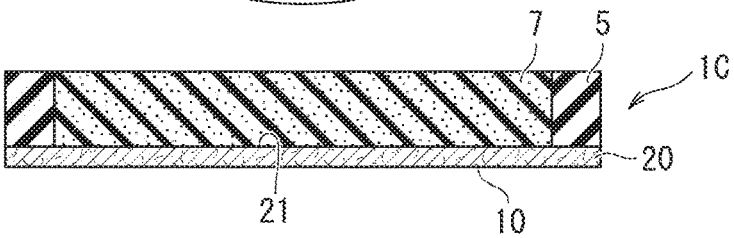

As illustrated in FIGS. 17A and 17B, a polishing pad 1C of the tenth embodiment is formed of the disc-shaped polishing layer 20, the disc-shaped support layer 7, and the water stop portion 5 formed on the outer peripheral surface of the support layer 7.

The polishing layer 20 is a suede type or a nonwoven fabric type polishing pad. The support layer 7 is made of foamed polyurethane (a porous material having an interconnected cell structure). The water stop portion 5 is made of foamed rubber (a porous material having a non-interconnected cell structure). The water absorption rate of the water stop portion 5 measured by the above-described method is 5% or less. That is, the support layer 7 is an interconnected cell layer, and the water stop portion 5 is formed at a part of the surface except for the polishing surface 10 of the interconnected cell layer.

The polishing layer 20 has the thickness of 0.5 mm or more and 5.0 mm or less. The support layer 7 has the thickness of 2.0 mm or more and 50 mm or less. The dimension in the axial direction of the water stop portion 5 is identical to the thickness of the support layer 7.

The polishing pad 1C can be obtained by, for example, the following method.

The suede type or the nonwoven fabric type polishing pad is cut into the disc shape to obtain the polishing layer 20. The support layer 7 is obtained by a method of punching a plate-shaped material made of foamed polyurethane into a disc shape using the Thomson die having a cylindrical blade. The water stop portion 5 is obtained by a method of punching a plate-shaped material made of foamed rubber into an annular shape using the Thomson die having two cylindrical blades of different diameters.

Using the obtained polishing layer 20, support layer 7, and water stop portion 5, first, the support layer 7 where the adhesive is attached to the outer peripheral surface is fitted to the inner peripheral surface of the water stop portion 5 to be integrated. Next, this integrated part is pasted to the opposite surface 21 to the polishing surface 10 of the polishing layer 20 with adhesive or a double-sided tape.

The polishing pad 1C of this embodiment is used by the polishing method with the polishing slurry. For example, a polished surface larger than the polishing surface 10 is polished using the polishing pad 1C. Specifically, the polishing slurry is supplied to the polished surface, the polishing surface 10 of the polishing pad 1C is pressed against the polished surface, and the polishing pad 1C is rotated around the axis of the disc.

When this polishing method is performed using the polishing pad where only the support layer 7 made of foamed polyurethane is formed on the opposite surface 21 to the polishing surface of the polishing layer 20, the slurry soaks through the support layer of the polishing pad and this soaked slurry disperses into the outside. The dispersed slurry is not used for polishing. In contrast to this, with the use of the polishing pad 1C of this embodiment, since the water stop portion 5 is formed at the outer peripheral surface of the support layer 7 made of foamed polyurethane, the slurry is less likely to soak to the support layer 7 from the outer peripheral portion, thereby reducing the amount of slurry dispersing into the outside. Accordingly, usage efficiency of the slurry becomes high.

Eleventh Embodiment

Figure 18A:
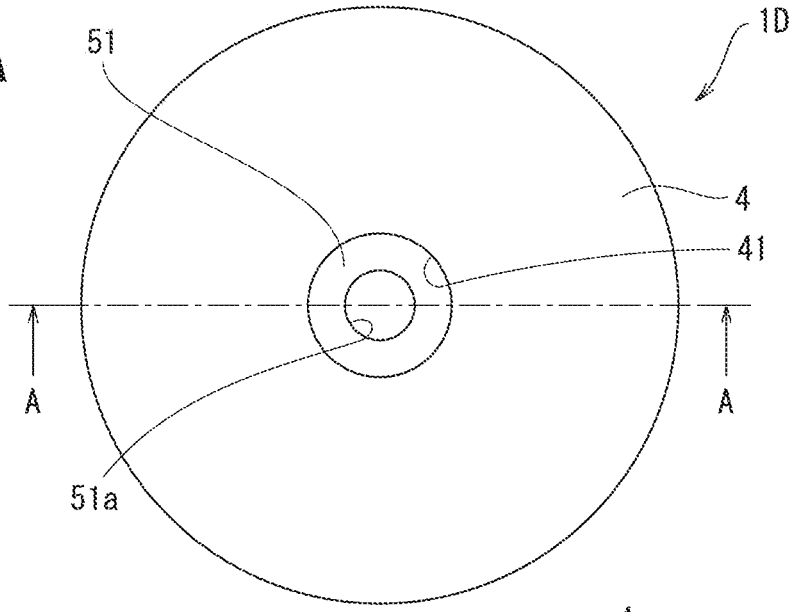
FIGS. 18A and 18B are drawings illustrating a polishing pad of an eleventh embodiment.
Figure 18B:
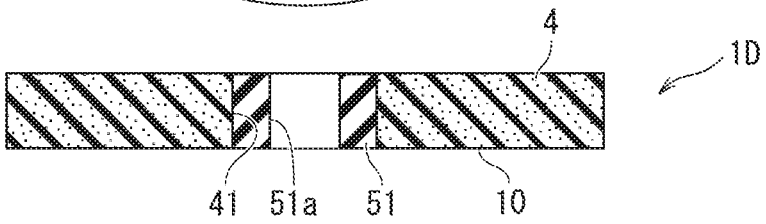

As illustrated in FIGS. 18A and 18B, a polishing pad 1D of the eleventh embodiment includes the disc-shaped main body 4 having a center hole 41 and an annular water stop portion 51 formed at the wall surface of the center hole 41. The main body 4 is made of foamed polyurethane (a porous material having an interconnected cell structure). The center hole 41 is a through-hole extending perpendicular to the polishing surface 10. The water stop portion 51 is made of foamed rubber (a porous material having a non-interconnected cell structure). The water absorption rate of the water stop portion 5 measured by the above-described method is 5% or less.

A center hole 51*a* of the water stop portion 51 is a through-hole extending perpendicular to the polishing surface 10. The center hole 51*a* of the water stop portion 51 is present as a center hole of the polishing pad 1D. That is, the main body 4 is an interconnected cell layer, and the water stop portion 51 is formed at a part of the surface except for the polishing surface 10 of the interconnected cell layer. The center hole 41 is a through-hole penetrating the interconnected cell layer.

The thickness of the polishing pad 1D, that is, the thickness of the main body 4 and a dimension in the axial direction of the water stop portion 51 is 2.0 mm or more and 50 mm or less.

The polishing pad 1D can be obtained by, for example, the following method.

The main body 4 is obtained by a method of punching a plate-shaped material made of foamed polyurethane into a disc shape with the center hole 41 using the Thomson die having two cylindrical blades of different diameters. The water stop portion 51 is obtained by a method of punching a plate-shaped material made of foamed rubber into an annular shape using the Thomson die having two cylindrical blades of different diameters. The water stop portion 51 where adhesive is attached to the outer peripheral surface is fitted to the center hole 41 of the main body 4 and the adhesive is hardened.

The polishing pad 1D of this embodiment is used by the polishing method with the polishing slurry. For example, a polished surface larger than the polishing surface 10 is polished using the polishing pad 1D. Specifically, the polishing pad 1D is disposed on the upper side of the polished surface, while the polishing slurry is dropped from the center hole 51*a* to the polished surface, the polishing surface 10 of the polishing pad 1D is pressed against the polished surface, and the polishing pad 1D is rotated around the axis of the disc.

When this polishing method is performed using the polishing pad made of foamed polyurethane absent of the water stop portion 51 and with the center hole, since the slurry soaks through the polishing pad and this soaked slurry disperses into the outside by strong centrifugal force, most slurry is not used for polishing. In contrast to this, with the use of the polishing pad 1D of this embodiment, the water stop portion 51 is formed at the wall surface of the center hole 41, and therefore the slurry is less likely to soak through the main body 4 made of urethane foam, reducing the amount of slurry dispersed into the outside. Accordingly, usage efficiency of the slurry becomes high.

Twelfth Embodiment

Figure 19A:
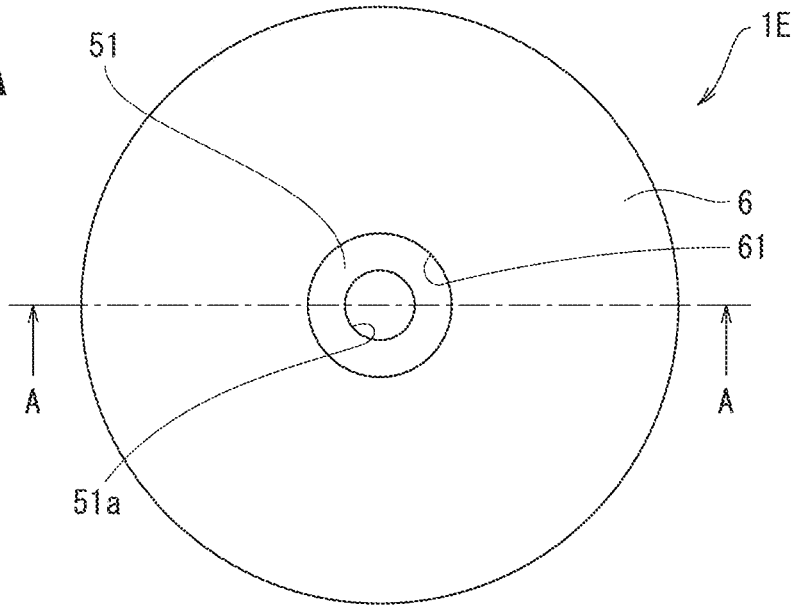
FIGS. 19A and 19B are drawings illustrating a polishing pad of a twelfth embodiment.
Figure 19B:
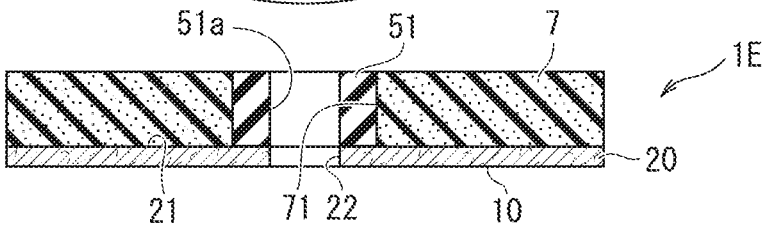

As illustrated in FIGS. 19A and 19B, a polishing pad 1E of the twelfth embodiment is formed of the disc-shaped polishing layer 20 having a center hole (a first through-hole) 22, the disc-shaped support layer 7 having a center hole (a second through-hole) 71, and the annular water stop portion 51 formed at a wall surface of the center hole 71. The center of the center hole 22 of the polishing layer 20 is identical to the center of the center hole 71 of the support layer 7. The center hole 51*a* of the water stop portion 51 is identical to the center hole 22 of the polishing layer 20, and these holes are present as the center holes of the polishing pad 1E.

The polishing layer 20 is a suede type or a nonwoven fabric type polishing pad. The support layer 7 is made of foamed polyurethane (a porous material having an interconnected cell structure). The water stop portion 51 is made of foamed rubber (a porous material having a non-interconnected cell structure). The water absorption rate of the water stop portion 5 measured by the above-described method is 5% or less. That is, the support layer 7 is an interconnected cell layer, and the water stop portion 51 is formed at a part of the surface except for the polishing surface 10 of the interconnected cell layer.

The polishing layer 20 has the thickness of 0.5 mm or more and 5.0 mm or less. The support layer 7 has the thickness of 2.0 mm or more and 50 mm or less. The dimension in the axial direction of the water stop portion 51 is identical to the thickness of the support layer 7.

The polishing pad 1E can be obtained by, for example, the following method.

The polishing layer 20 is obtained by a method of punching the suede type or the nonwoven fabric type polishing pad into a disc shape with the center hole 22 using the Thomson die having two cylindrical blades of different diameters. The support layer 7 is obtained by a method of punching a plate-shaped material made of foamed polyurethane into a disc shape with the center hole 71 using the Thomson die having two cylindrical blades of different diameters. The water stop portion 51 is obtained by a method of punching a plate-shaped material made of foamed rubber into an annular shape using the Thomson die having two cylindrical blades of different diameters.

Using the obtained polishing layer 20, support layer 7, and water stop portion 51, first, the water stop portion 51 where the adhesive is attached to the outer peripheral surface is fitted to the center hole 71 of the support layer 7 to be integrated. Next, this integrated part is pasted to the opposite surface 21 to the polishing surface 10 of the polishing layer 20 with adhesive or a double-sided tape.

The polishing pad 1E of this embodiment is used by the polishing method with the polishing slurry. For example, a polished surface larger than the polishing surface 10 is polished using the polishing pad 1E. Specifically, the polishing pad 1E is disposed on the upper side of the polished surface. While the polishing slurry is dropped from the center hole 51*a* of the water stop portion 51 to the polished surface via the center hole 22 of the polishing layer 20, the polishing surface 10 of the polishing pad 1E is pressed against the polished surface, and the polishing pad 1E is rotated around the axis of the disc.

When this polishing method is performed using the polishing pad absent of the water stop portion 51 and including the support layer made of foamed polyurethane having the center hole at the position identical to the center hole 22 on the polishing layer 20 formed on the opposite surface 21 to the polishing surface of the polishing layer 20, the slurry soaks through the support layer of the polishing pad. Since this soaked slurry disperses into the outside by strong centrifugal force, most slurry is not used for polishing. In contrast to this, with the use of the polishing pad 1E of this embodiment, the water stop portion 51 is formed at the wall surface of the center hole 71, and therefore the slurry is less likely to soak through the support layer 7 made of urethane foam, reducing the amount of slurry dispersed into the outside. Accordingly, usage efficiency of the slurry becomes high.

<Water Stop Portion>

The water absorption rate of the water stop portion measured by the above-described method is preferably 5% or less. When the polishing pad has a single layer and has an interconnected cell layer made of a porous material with an interconnected cell structure, the water stop portion preferably has the hardness identical to or similar to that of the interconnected cell layer. Accordingly, the water stop portion is preferably made of the porous material having the non-interconnected cell structure in this case.

In the case where the polishing pad has a two-layer structure formed of the polishing layer and the support layer and the support layer is the interconnected cell layer made of a porous material with the interconnected cell structure, the water stop portion preferably has the hardness identical to or similar to that of the support layer. Accordingly, the water stop portion is preferably made of the porous material having the non-interconnected cell structure in this case. Additionally, in this case, even when a part of the polishing layer is the interconnected cell layer, the thickness of the interconnected cell layer of the polishing layer is extremely thinner than the thickness of the support layer; therefore, the water stop portion needs not to be disposed at the polishing layer.

Foamed polyurethane or foamed polyethylene is preferably used as the porous material of the interconnected cell structure constituting the polishing pad in the single layer and the support layer in the two-layer structure.

The porous material of the non-interconnected cell structure constituting the water stop portion includes foamed rubber (for example, chloroprene rubber foam, ethylene propylene rubber foam, silicone rubber foam, fluororubber foam, polyurethane foam, and polyethylene foam). Among these components, the non-interconnected cell structure is easily obtainable from the chloroprene rubber foam and the ethylene propylene rubber foam and therefore the chloroprene rubber foam and the ethylene propylene rubber foam are preferable.

The formation method of the water stop portion, for example, includes the following methods in addition to the method described in the above-described embodiments: a method of applying and drying liquid containing a water stop material, a method of impregnating and hardening adhesive or the like into an interconnected cell layer to cover holes of the interconnected cell layer, and a method of pasting a tape made of a water stop material.

<Support Layer>

When the polishing pad has the two-layer structure formed of the polishing layer and the support layer, that is, the support layer is formed on the surface opposite to the polishing surface of the polishing layer, the polishing layer is preferably made of a material harder than the support layer. That is, the support layer is preferably softer than the polishing layer, and therefore the polishing surface of the polishing layer easily follows the polished surface in the case of the polished surface being a curved surface.

In the case where the polishing pad has the polishing layer and the support layer, the hardness of the polishing layer is preferably the C hardness of 40 or more and 80 or less and the hardness of the support layer is preferably the F hardness of 30 or more and 90 or less. The F hardness 90 is equivalent to less than the C hardness 10.

The C hardness means hardness immediately after a pressing surface is in close contact by a testing method specified in "Spring Hardness Test Type C Testing Method" in an appendix 2 in JIS K7312: 1996. This testing method uses a spring hardness testing machine having a structure that indicates a distance of an indenter protruding from a hole at a center of the pressing surface by spring pressure being pressed to return by a test specimen when the pressing surface of the testing machine is brought into close contact with a surface of the test specimen by scale as the hardness. The measured surface of the test specimen has a size at least equal to or more than the pressing surface of the testing machine.

The F hardness means hardness measured by "ASKER Durometer Type F" manufactured by Kobunshi Keiki Co., Ltd. The ASKER Durometer Type F is a durometer having a large indenter and pressing surface such that an appropriate instruction value is obtained in especially hardness measurement of a soft specimen, and a shape of the indenter is a cylindrical shape with a height of 2.54 mm and a diameter of 25.2 mm.

<Preferable Configuration and Like of Polishing Pad of Fourth Aspect>

When the polishing pad has the two-layer structure formed of the polishing layer and the support layer, that is, the support layer is formed on the surface opposite to the polishing surface of the polishing layer, the polishing layer preferably has the thickness of 0.5 mm or more and 5.0 mm or less. The polishing layer easily removes the undulation with the thickness in the range, and the polishing layer easily deforms similar to the support layer.

The polishing surface preferably has the diameter of 10 mm or more and 200 mm or less. The diameter in the range ensures shortening a time taken for the slurry to go across from the outer edge portion to the center portion of the polishing surface and the polishing surface easily follows the polished surface with the curved surface shape.

Not only the surface made of synthetic resin, the polished surface may also be, for example, a metal surface, a silicon wafer surface, a glass surface, and a sapphire surface.

<Example of Method for Manufacturing Polishing Layer of Polishing Pad of Fourth Aspect>

The suede type: for example, nonwoven fabric and woven fabric made of synthetic fiber, synthetic rubber, or the like or a polyester film or the like is used as the base material. Applying polyurethane-based solution on the top surface of the base material and solidifying the polyurethane-based solution by wet coagulation method forms a skin layer of a porous layer having continuous pores. The surface of the skin layer is ground and removed as necessary.

The nonwoven fabric type: for example, polyurethane elastomer solution is impregnated into needle-punched nonwoven fabric made of polyester short fiber. The nonwoven fabric in this state is dipped into water, the wet coagulation is performed, and then the nonwoven fabric is cleaned with water and dried, and after the drying, a grinding process is performed on both surfaces. Alternatively, for example, thermosetting urethane resin solution is impregnated into the needle-punched nonwoven fabric made of polyester short fiber. By drying the nonwoven fabric in this state, after thermosetting urethane resin is fixed to the nonwoven fabric, a sanding process is performed on both surfaces to remove unevenness.

<Polishing Method Using Polishing Pad of Fourth Aspect>

The polishing pad of the present invention is preferably used by a polishing method with the polishing slurry and a method of polishing the polished surface larger than the polishing surface. Additionally, the polishing method that presses the polishing surface of the polishing pad against the polished surface and moves the polishing pad is preferably used. As long as the polishing method using the polishing slurry, a method other than these methods may be used.

When the polishing pad of the present invention has a through-hole extending in a direction intersecting with the polishing surface, a polishing method that disposes the polishing pad on the upper side of the polished surface, presses the polishing surface of the polishing pad against the polished surface while dropping the polishing slurry from this through-hole to the polished surface, and rotates the polishing pad can be employed. With this polishing method, the polishing slurry soaked through the interconnected cell layer from the through-hole is likely to disperse into the outside of the polishing pad by the strong centrifugal force during the rotation of the polishing pad. Therefore, the use of the polishing pad including the water stop portion of the present invention ensures effectively increasing the usage efficiency of the slurry.

Further, a method of supplying the polishing slurry to the polished surface includes, for example, a method of dropping the polishing slurry via the above-described through-hole, a method of dropping the polishing slurry to the outside of the polishing pad, and a method of spraying the slurry.

<Polishing Slurry Used by Polishing Method Using Polishing Pad of Fourth Aspect>

The polishing method with the polishing slurry uses the slurry containing the abrasives. The abrasives contained in the slurry include abrasives selected from, for example, particles made of silicon such as silica, alumina, ceria, titania, zirconia, iron oxide, and manganese oxide or oxide of a metallic element, organic particles made of thermoplastic resin or organic/inorganic compound particles.

For example, the use of alumina slurry containing alumina particles allows high polishing removal rate, and the alumina slurry is easily obtainable and therefore is preferable.

There are aluminas of different crystal forms such as α-alumina, β-alumina, γ-alumina, and θ-alumina, and also an aluminum compound referred to as hydrated alumina is present. From an aspect of the polishing removal rate, the use of the slurry containing the particles mainly constituted of the α-alumina as the abrasives is more preferable.

The average particle diameter of the abrasives is preferably 0.1 μm or more and 10.0 μm or less and more preferably 0.3 μm or more and 5.0 μm or less. The larger the average particle diameter is, the more the polishing removal rate is improved. The average particle diameter within the range easily improves the polishing removal rate up to a level especially preferable for practical use. The smaller the average particle diameter is, the more the dispersion stability of the abrasives is improved, reducing scratches (scratches) of the polishing surface.

The average particle diameter within the range easily improves the dispersion stability of the abrasives and surface accuracy of the polishing surface up to a level especially preferable for practical use.

The content of the abrasives in the slurry is preferably 0.1 mass % or more and 50 mass % or less, more preferably 0.2 mass % or more and 25 mass % or less, and further preferably 0.5 mass % or more and 20 mass % or less. The larger the content of the abrasives is, the more the polishing removal rate is improved. The content of the abrasives within the range easily improves the polishing removal rate up to the level especially preferable for practical use while the cost is reduced. Surface defects on the surface of the object to be polished after the polishing can be further reduced.

In addition to the abrasives and the dispersing agent, the slurry may appropriately contain another component such as lubricating oil, organic solvent, surfactant, and thickener as necessary. The lubricating oil may be synthetic oil, mineral oil, vegetable oil, or a combination of these oils. In addition to hydrocarbon-based solvent, the organic solvent may be, for example, alcohol, ether, glycols, and glycerin. The surfactant may be so-called anionic, cationic, nonionic, or amphoteric surfactant. The thickener may be synthetic thickener, cellulosic thickener, or natural thickener.

[Polishing Device Usable by Polishing Method Using Polishing Pad of Fourth Aspect]

The polishing pad of the fourth aspect is the polishing pad used for the polishing with the slurry; therefore, as long as this polishing pad is mountable and the polishing surface can be pressed against the polished surface and the polishing pad can be moved, any polishing device is applicable. The example of the polishing device includes the polisher 9 illustrated in FIG. 12, the automatic polishing device 400 illustrated in FIG. 24, and the hand polisher described above.

Example 1

Example 1 describes examples and comparative examples of the polishing methods of the first aspect and the second aspect.

Each polishing pad of Samples No. 1 to No. 7 described below was prepared.

The polishing pad of Sample No. 1 is the polishing pad with support layer 8 illustrated in FIGS. 6A and 6B. The polishing pad 6 has the disc shape with the diameter of 90 mm and the thickness of 1.3 mm, is the suede type, and has the C hardness of 50. The polishing pad 6 is divided into the end portion 61 and the base portion 62. The peripheral surface 611 of the end portion 61 is the arc surface. The support layer 7 is bonded to the surface 621, which is on the side opposite to the polishing surface of the polishing pad 6. The support layer 7 has a disc body with the diameter of 90 mm and the thickness of 10 mm, is made of urethane foam, and has the F hardness of 70.

Figure 8:
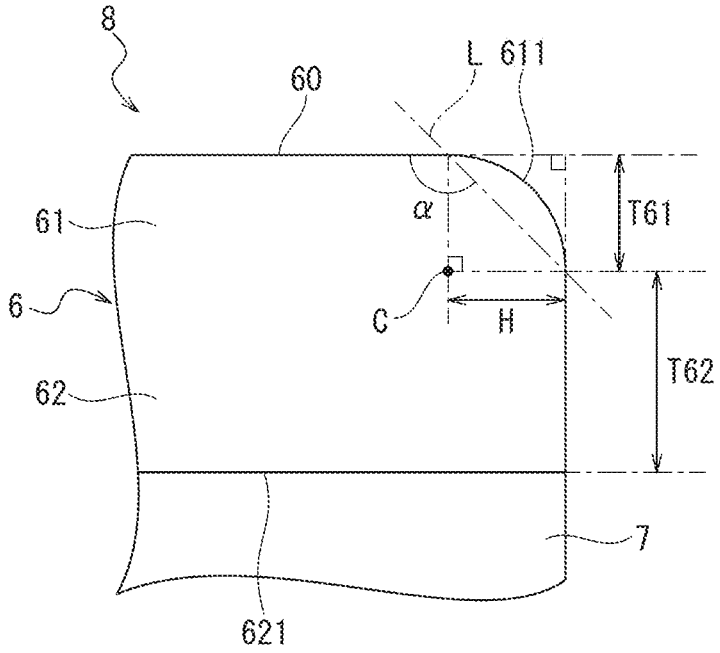
FIG. 8 is a schematic diagram describing a shape of a polishing pad used for a test of Example 1.

As illustrated in FIG. 8, an axial dimension T61 of the end portion 61 is 0.3 mm, and an axial dimension T62 of the base portion 62 is 1.0 mm. The arc forming the peripheral surface 611 is a quadrant arc of a circle with the axial dimension T61 of the end portion 61 as the radius. That is, a center of C of the arc forming the peripheral surface 611 is a point where a distance H from a peripheral surface of the base portion 62 becomes identical to T61. Additionally, defining a straight line connecting a boundary point between the end portion 61 and the base portion 62 to a boundary point between the polishing surface 60 and the peripheral surface 611 as L on a cross-sectional surface along the diameter of the polishing pad 6, an angle α formed by the straight line L and the polishing surface 60 is 135°.

The polishing pads of Samples No. 2 to No. 6 are the polishing pads with support layers 3 illustrated in FIGS. 3A and 3B. The polishing pad 1 has the disc shape with the diameter of 90 mm and the thickness of 1.3 mm, is the suede type, and has the C hardness of 50. The polishing pad 1 is divided into the end portion 11 and the base portion 12. The peripheral surface 111 of the end portion 11 is the tapered surface whose diameter is reduced to the polishing surface 10, and the angle θ formed by the peripheral surface 111 and the polishing surface 10 is an obtuse angle. The support layer 2 is bonded to the surface 121, which is on the side opposite to the polishing surface of the polishing pad 1. The support layer 2 has a disc body with the diameter of 90 mm and the thickness of 10 mm, is made of urethane foam, and has the F hardness of 70.

Figure 9:
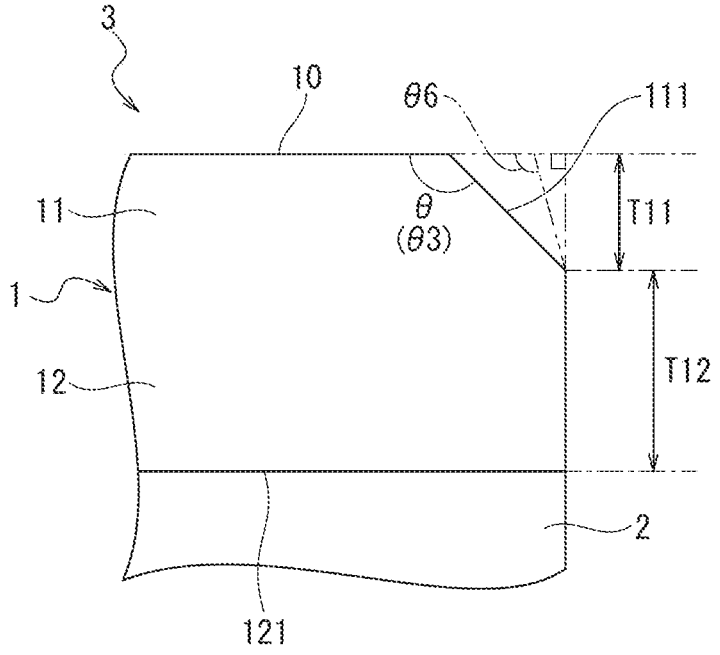
FIG. 9 is a schematic diagram describing a shape of a polishing pad used for the test of Example 1.

As illustrated in FIG. 9, the end portion 11 has an axial dimension T11 of 0.3 mm, and the base portion 12 has an axial dimension T12 of 1.3 mm. No. 2 has θ=150°, No. 3 has θ=135° (since θ in FIG. 9 is 135°, the θ is indicated as θ3 with parentheses), No. 4 has θ=125°, No. 5 has θ=120°, and No. 6 has θ=105° (θ6 in FIG. 9). The difference in the angle θ changes the outer diameter of the polishing surface 10.

The polishing pad of Sample No. 7 has a disc shape with the diameter of 90 mm and the thickness of 1.3 mm, is the suede type, and has the C hardness of 50. A support layer is bonded to a surface on a side opposite to the polishing surface of the polishing pad. The support layer has a disc body with the diameter of 90 mm and the thickness of 10 mm, is made of urethane foam, and has the F hardness of 70. With this polishing pad, a corner portion formed by a peripheral surface on the polishing surface side and the polishing surface is 90°.

A polish test was conducted using the polishing pad of each sample by the following method.

Objects to be polished are metal plates of 300×250 mm coated with synthetic resin coating and the thickness of the coated film is 20 μm. That is, the polished surface is the coated film surface made of the synthetic resin, and the polished surface is larger than the polishing surface.

A polishing device used is a device where a double action polishing disc is mounted to a distal end of an arm of "M-20iA", an industrial robot manufactured by FANUC CORPORATION. Assuming polishing of a concave curved surface with a curvature radius of 50 mm, the polishing pad was disposed such that an angle formed by the coated film surface as the polished surface and the polishing surface became 30°. While the polishing pad of each sample was pressed against the polished surface by pressing force given to the arm and the slurry containing the abrasives with an average grain diameter of 0.4 μm was supplied to the polished surface outside the polishing pad, the polishing disc was rotated for polishing. Polish conditions were identical among all samples.

After performing this polishing by two sets in each sample, the polished surface after the polishing was observed by visual check, and a count of scratches included in an area of 100 $mm^2$ was calculated. The smaller the count of scratches included in the area of 100 $mm^2$ is determined to be preferable, and the count of 10 or more is determined to be problematic.

Figure 10:
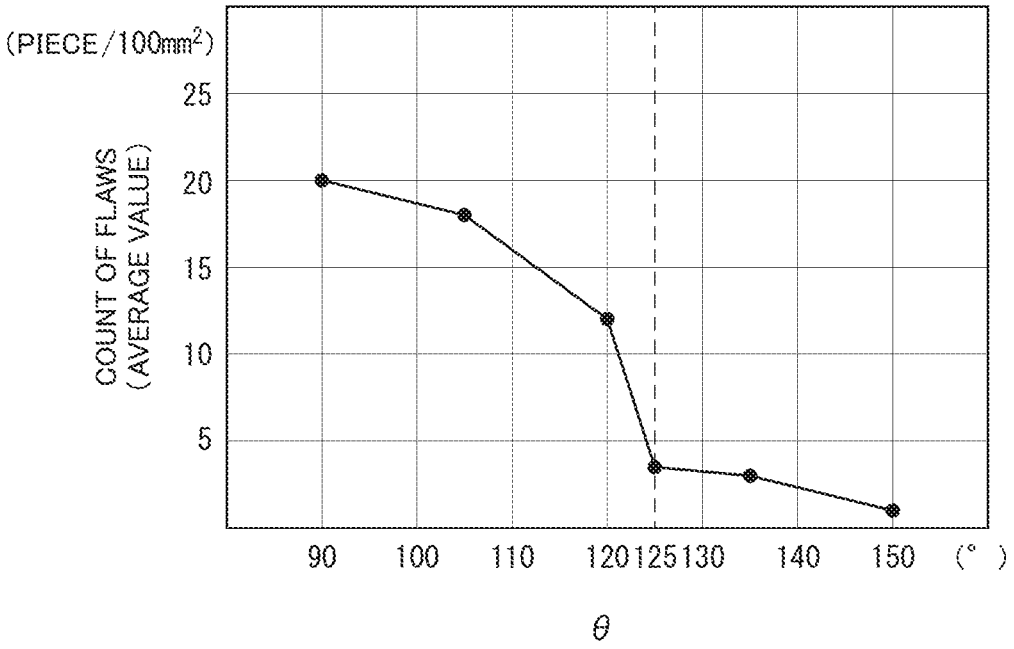
FIG. 10 is a graph illustrating a relationship between an angle θ formed by a peripheral surface of an end portion and a polishing surface and a count of scratches (an average value) obtained from a test result of Example 1.

Table 1 shows the configuration of the polishing pad of each sample and results of the evaluation. The results of the evaluation show the average value of the two sets. FIG. 10 illustrates a relationship between the angle θ formed by the peripheral surface of the end portion and the polishing surface and the count of scratches (the average value) of the results of No. 2 to No. 7 in a graph.

TABLE 1

| No. | Difference in polishing pad Peripheral surface of end portion | Evaluation Average value of flaw (piece/$mm^2$) | Remarks |
|---|---|---|---|
| 1 | Arc surface | 0 | Example |
| 2 | Tapered surface (θ = 150°) | 1 | Example |
| 3 | Tapered surface (θ = 135°) | 3 | Example |
| 4 | Tapered surface (θ = 125°) | 3.5 | Example |
| 5 | Tapered surface (θ = 120°) | 12 | Comparative example |
| 6 | Tapered surface (θ = 105°) | 18 | Comparative example |
| 7 | Surface identical to base portion (θ = 90°) | 20 | Comparative example |

The following can be said from these results.

The polishing methods using the polishing pads No. 1 to No. 4 equivalent to the examples of the present invention effectively reduce polishing scratches when a concave curved surface formed of the coated film is polished compared with the polishing methods using the polishing pads No. 5 to No. 7 equivalent to the comparative examples.

Among the polishing pads No. 2 to No. 6, which have the peripheral surface of the end portion being the tapered surface whose diameter is reduced to the polishing surface and the angle θ formed by the peripheral surface and the polishing surface being the obtuse angle, the use of the polishing methods using the polishing pads with θ of 125° or more provides a significantly large effect of ensuring reducing polishing scratches when the concave curved surface formed of the coated film is polished compared with the polishing method where θ is 120° or less.

Example 2

Example 2 describes examples and comparative examples of the polishing method of the third aspect.

Each polishing pad of Samples No. 11 to No. 19 described below was prepared.

The polishing pad of Sample No. 11 has a disc shape with the diameter of 90 mm and the thickness of 10 mm, is made of urethane foam, and has the F hardness of 70. A groove is not formed on the polishing surface.

The polishing pad of Sample No. 12 has a disc shape with the diameter of 90 mm and the thickness of 1.3 mm, is the suede type, and has the C hardness of 30. A groove is not formed on the polishing surface. A support layer is bonded to a surface on a side opposite to the polishing surface of the polishing pad. The support layer has a disc body with the diameter of 90 mm and the thickness of 10 mm, is made of urethane foam, and has the F hardness of 70.

The polishing pad of Sample No. 13 has a disc shape with the diameter of 90 mm and the thickness of 1.3 mm, is the suede type, and has the C hardness of 30. A grid-like groove is formed on the polishing surface. A formation method of the groove is a method that removes a material at a part becoming the groove from the suede type polishing pad absent of the groove by cutting (hereinafter referred to as "cutting method"). The groove width is 1 mm, the groove pitch is 6 mm, and the groove depth is approximately 400 μm. The support layer identical to Sample No. 2 is bonded to a surface on a side opposite to the polishing surface of the polishing pad.

The polishing pad of Sample No. 14 has a disc shape with the diameter of 90 mm and the thickness of 1.3 mm, is the suede type, and has the C hardness of 50. A groove is not formed on the polishing surface. A support layer is bonded to a surface on a side opposite to the polishing surface of the polishing pad. The support layer has a disc body with the diameter of 90 mm and the thickness of 10 mm, is made of urethane foam, and has the F hardness of 70.

The polishing pad of Sample No. 15 has a disc shape with the diameter of 90 mm and the thickness of 1.3 mm, is the suede type, and has the C hardness of 50. A grid-like groove is formed on the polishing surface by the cutting method. The groove width is 1 mm, the groove pitch is 6 mm, and the groove depth is approximately 400 μm. The support layer identical to Sample No. 2 is bonded to a surface on a side opposite to the polishing surface of the polishing pad.

The polishing pad of Sample No. 16 has a disc shape with the diameter of 90 mm and the thickness of 1.3 mm, is the nonwoven fabric type, and has the C hardness of 80. A groove is not formed on the polishing surface. The support layer identical to Sample No. 2 is bonded to a surface on a side opposite to the polishing surface of the polishing pad.

The polishing pad of the sample No. 17 has a disc shape with the diameter of 90 mm and the thickness of 1.3 mm, is the nonwoven fabric type, and has the C hardness of 80. A grid-like groove is formed on the polishing surface by the cutting method. The groove width is 1 mm, the groove pitch is 6 mm, and the groove depth is approximately 400 μm. The support layer identical to Sample No. 2 is bonded to a surface on a side opposite to the polishing surface of the polishing pad.

The polishing pad of Sample No. 18 has a disc shape with the diameter of 90 mm and the thickness of 1.3 mm, is the nonwoven fabric type, and has the C hardness of 90. A groove is not formed on the polishing surface. The support layer identical to Sample No. 2 is bonded to a surface on a side opposite to the polishing surface of the polishing pad.

The polishing pad of Sample No. 19 has a disc shape with the diameter of 90 mm and the thickness of 1.3 mm, is the nonwoven fabric type, and has the C hardness of 90. A grid-like groove is formed on the polishing surface by the cutting method. The groove width is 1 mm, the groove pitch is 6 mm, and the groove depth is approximately 400 μm. The support layer identical to Sample No. 2 is bonded to a surface on a side opposite to the polishing surface of the polishing pad.

A polish test was conducted using the polishing pad of each sample by the following method.

Objects to be polished are metal plates of 300×250 mm coated with synthetic resin coating and the thickness of the coated film is 20 μm. That is, the polished surface is the coated film surface made of the synthetic resin, and the polishing surface is smaller than the polished surface.

A polishing device used is a device where a double action polishing disc is mounted to a distal end of an arm of "M-20iA", an industrial robot manufactured by FANUC CORPORATION. While the polishing pad of each sample was pressed against the polished surface by pressing force given to the arm and the slurry was supplied to the polished surface outside the polishing pad, the polishing disc was rotated for polishing. Polish conditions were identical among all samples.

The used slurry contains alumina abrasives with the average grain diameter of 0.4 μm. The used slurry has viscosity of 0.11 Pa·s (1.1 cP) at 25° C. The average grain diameter of abrasives was measured using a particle diameter distribution measuring device "Horiba L-950" manufactured by HORIBA, Ltd.

After performing this polishing by two sets in each sample, the samples were evaluated for removability of undulation of the polished surfaces and scratch resistance.

A contact-type surface roughness measuring device manufactured by TOKYO SEIMITSU CO., LTD., "SURFCOM 1500DX" was used for the evaluation of the undulation removability. The "filtered wave central undulation" of the coated film surface as the polished surface was measured to obtain arithmetic mean waviness (Wa). The value of the calculated mean waviness (Wa) before the polishing was approximately 0.1 μm. Wa of the polished surface after the polishing of 0.03 μm or less is determined that the surface especially has small undulation and therefore is excellent. Wa of more than 0.03 μm and less than 0.06 μm is determined that the undulation is small and in a range not causing a problem. Wa of 0.06 μm or more is determined that the undulation is large and therefore has a problem.

The scratch resistance (unlikeliness of a scratch on the polished surface) was observed by visual check of the polished surface after the polishing, and a count of scratches included in an area of 100 $mm^2$ was evaluated. The smaller the count of scratches included in the area of 100 $mm^2$ is determined to be preferable, and the count of 10 or more is determined to be problematic.

Table 2 shows the configuration of the polishing pad of each sample and results of the evaluation. The results of the evaluation show the average value of the two sets.

TABLE 2

| | | No. 11 | No. 12 | No. 13 | No. 14 | No. 15 | No. 16 | No. 17 | No. 18 | No. 19 |
|---|---|---|---|---|---|---|---|---|---|---|
| Configuration of polishing pad | Type | Urethane foam | Suede type | | | | Nonwoven fabric type | | | |
| | Hardness | F70 | C30 | | | C50 | C80 | | | C90 |
| | Thickness (mm) | 10 | 1.3 (+Support layer 10) | | | | 1.3 (+Support layer 10) | | | |

TABLE 2-continued

| | | No. 11 | No. 12 | No. 13 | No. 14 | No. 15 | No. 16 | No. 17 | No. 18 | No. 19 |
|---|---|---|---|---|---|---|---|---|---|---|
| | Presence/absence of groove | Absent | Absent | Present | Absent | Present | Absent | Present | Absent | Present |
| | Groove width (mm) | — | — | 1 | — | 1 | — | 1 | — | 1 |
| | Groove pitch (mm) | — | — | 6 | — | 6 | — | 6 | — | 6 |
| Evaluation | Wa (μm) | 0.09 | 0.08 | 0.08 | 0.05 | 0.05 | 0.02 | 0.02 | 0.02 | 0.02 |
| | Flaw (piece/mm$^2$) | 1 | 1 | 0 | 2 | 0 | 11 | 7 | 20 | 10 |

The following can be found from these results.

The use of the polishing pads No. 14 to No. 19 with the C hardness of 50 or more and 90 or less ensures effectively removing the undulation of the polished surface.

Comparing the methods (No. 12 and No. 13, No. 14 and No. 15, No. 16 and No. 17, and No. 18 and No. 19) using the polishing pads with the identical hardness, the use of the polishing pad having the groove on the polishing surface improves the scratch resistance compared with the case of using the polishing pad absent of the groove.

Comparing the methods (No. 13, No. 15, No. 17, and No. 19) using the polishing pads having the identical groove on the polishing surface and different hardnesses, as the used polishing pad softens, the polishing pad is excellent in scratch resistance.

Comparing the methods (No. 12, No. 14, No. 16, and No. 18) using the polishing pads absent of the groove on the polishing surface and having the different hardnesses, as the used polishing pad softens, the polishing pad is excellent in scratch resistance.

The use of the polishing pads No. 15 and No. 17, which have the C hardness of 50 or more and 80 or less and the groove on the polishing surface, effectively removes the undulation of the polished surface when the polished surface is the coated film surface made of synthetic resin, thereby ensuring reducing the polishing scratches.

The identical test was conducted using each of the polishing pads No. 12 to No. 19 to which the support layer was not bonded. Then, the results identical to No. 12 to No. 19 in Table 2 were obtained regarding the evaluations on Wa and the scratches. The polishing pads to which the support layer was bonded exhibited high following capability to the curved surface compared with the polishing pads to which the support layer was not bonded.

Example 3

Example 3 describes examples and comparative examples of the polishing method of the fourth aspect.

Each polishing pad of Samples No. 21 to No. 30 described below was prepared.

[Sample No. 21]

The polishing pad of Sample No. 21 corresponds to the polishing pad 1 of the seventh embodiment illustrated in FIGS. 14A and 14B, has the disc shape with the diameter of 90 mm and the thickness of 10 mm. The polishing pad is formed by punching a plate-shaped material made of chloroprene rubber foam with the water absorption rate of 5% or less measured by the above-described method using the Thomson die. That is, the entire polishing pad is formed of the water stop raw material.

[Sample No. 22]

The polishing pad of Sample No. 22 corresponds to the polishing pad 1A of the eighth embodiment illustrated in FIGS. 15A and 15B, which is formed of the polishing layer 20 and the support layer 30.

The polishing layer 20 is the nonwoven fabric type polishing pad and has the disc shape with the diameter of 90 mm and the thickness of 1.3 mm. The support layer 30 is fixed to the opposite surface 21 to the polishing surface 10 of the polishing layer 20. The support layer 30 has the disc shape with the diameter of 90 mm and the thickness of 10 mm. The support layer 30 is formed by punching a plate-shaped material made of chloroprene rubber foam with the water absorption rate of 5% or less measured by the above-described method using the Thomson die. That is, the entire support layer 30 is formed of the water stop raw material.

[Sample No. 23]

The polishing pad of Sample No. 23 corresponds to the polishing pad 1B of the ninth embodiment illustrated in FIGS. 16A and 16B, which is formed of the main body 4 and the water stop portion 5 fixed to the outer peripheral surface of the main body 4. That is, the water stop portion 5 is formed at the outer peripheral portion of the polishing pad.

The main body 4 has the disc shape made of foamed polyurethane with the diameter of 80 mm and the thickness of 10 mm. The water stop portion 5 has an annular shape with the inner diameter of 80 mm, the outer diameter of 90 mm, and the axial dimension of 10 mm. The water stop portion 5 is formed by punching a plate-shaped material made of chloroprene rubber foam with the water absorption rate of 5% or less measured by the above-described method using the Thomson die.

[Sample No. 24]

The polishing pad of Sample No. 24 corresponds to the polishing pad 1C of the tenth embodiment illustrated in FIGS. 17A and 17B, which is formed of the polishing layer 20, the support layer 7, and the water stop portion 5.

The polishing layer 20 is the nonwoven fabric type polishing pad and has the disc shape with the diameter of 90 mm and the thickness of 1.3 mm. The support layer 7 has the disc shape made of foamed polyurethane with the diameter of 80 mm and the thickness of 10 mm. The water stop portion 5 has an annular shape with the inner diameter of 80 mm, the outer diameter of 90 mm, and the axial dimension of 10 mm. The water stop portion 5 is formed by punching a plate-shaped material made of chloroprene rubber foam with the water absorption rate of 5% or less measured by the above-described method using the Thomson die.

The support layer 7 is fixed to the inner peripheral surface of the water stop portion 5. That is, the water stop portion 5 is formed at the outer peripheral portion of the support layer 7. The support layer 7 and the water stop portion 5 are fixed to the opposite surface 21 to the polishing surface 10 of the polishing layer 20.

[Sample No. 25]

The polishing pad of Sample No. 25 corresponds to the polishing pad 1D of the eleventh embodiment illustrated in FIGS. 18A and 18B, which is formed of the main body 4 having the center hole 41 and the water stop portion 51 formed at the wall surface of the center hole 41.

The main body 4 is made of foamed polyurethane and has the diameter of 90 mm, the center hole of 20 mm, and the thickness of 10 mm. The water stop portion 51 has an annular shape with the inner diameter (the diameter of the center hole 51*a*) of 10 mm, the outer diameter of 20 mm, and the axial dimension of 10 mm. The water stop portion 51 is formed by punching a plate-shaped material made of chloroprene rubber foam with the water absorption rate of 5% or less measured by the above-described method using the Thomson die.

[Sample No. 26]

The polishing pad of Sample No. 26 corresponds to the polishing pad 1E of the twelfth embodiment illustrated in FIG. 19, which is formed of the polishing layer 20 having the center hole 22, the support layer 7 having the center hole 71, and the water stop portion 51 formed at the wall surface of the center hole 71.

The polishing layer 20 is the nonwoven fabric type polishing pad with the outer diameter of 90 mm, the center hole 22 of 10 mm, and the thickness of 1.3 mm. The support layer 7 is made of foamed polyurethane and has the diameter of 90 mm, the center hole of 20 mm, and the thickness of 10 mm. The water stop portion 51 has an annular shape with the inner diameter (the diameter of the center hole 51*a*) of 10 mm, the outer diameter of 20 mm, and the axial dimension of 10 mm. The water stop portion 51 is formed by punching a plate-shaped material made of chloroprene rubber foam with the water absorption rate of 5% or less measured by the above-described method using the Thomson die.

The water stop portion 5 is fixed to the inner peripheral surface of the support layer 7. The support layer 7 and the water stop portion 5 are fixed to the opposite surface 21 to the polishing surface 10 of the polishing layer 20.

[Sample No. 27]

Figure 20A:
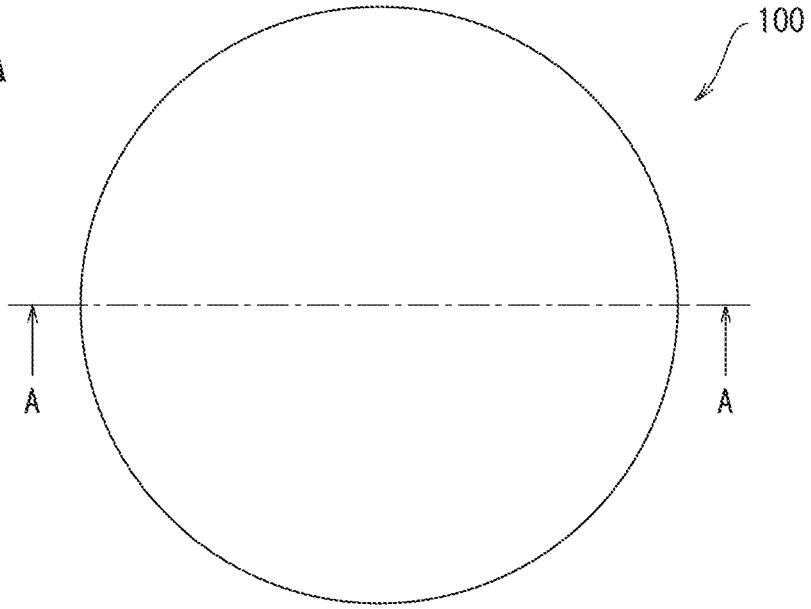
FIGS. 20A and 20B are drawings illustrating a polishing pad of a comparative example relative to the fifth and the ninth embodiments.
Figure 20B:
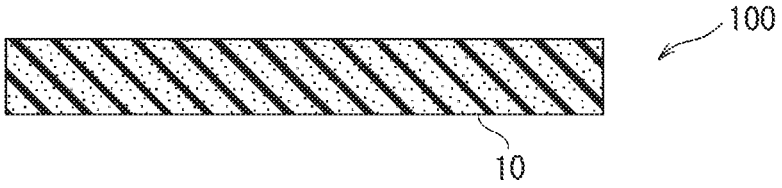

As illustrated in FIGS. 20A and 20B, the polishing pad 100 of Sample No. 27 is made of foamed polyurethane and has a disc shape with the diameter of 90 mm and the thickness of 10 mm.

[Sample No. 28]

Figure 21A:
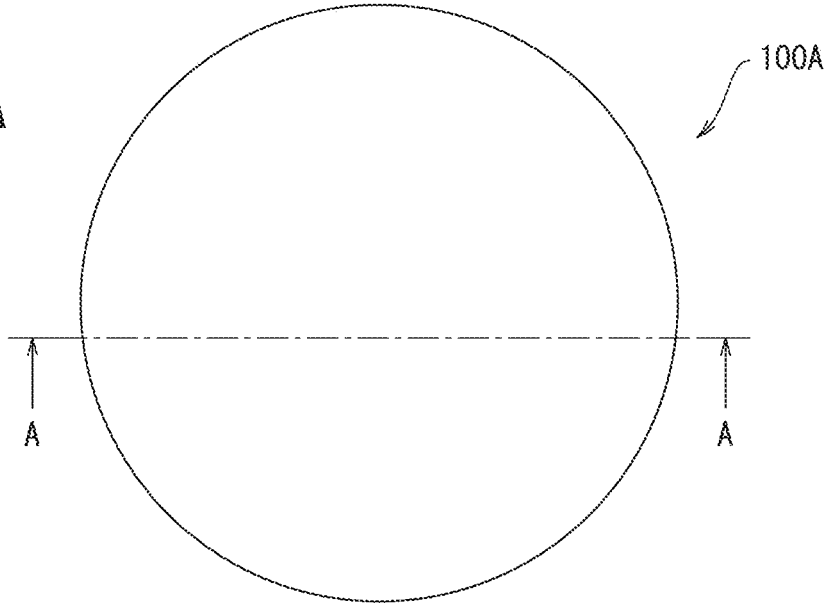
FIGS. 21A and 21B are drawings illustrating a polishing pad of a comparative example relative to the sixth and the tenth embodiments.
Figure 21B:
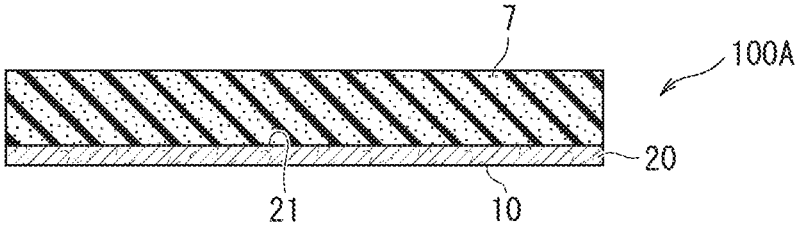

As illustrated in FIGS. 21A and 21B, a polishing pad 100A of Sample No. 28 is formed of the polishing layer 20 and the support layer 30.

The polishing layer 20 is the nonwoven fabric type polishing pad and has the disc shape with the diameter of 90 mm and the thickness of 1.3 mm. The support layer 30 is made of foamed polyurethane, has the disc shape with the diameter of 90 mm and the thickness of 10 mm, and is fixed to the opposite surface 21 to the polishing surface 10 of the polishing layer 20.

[Sample No. 29]

Figure 22A:
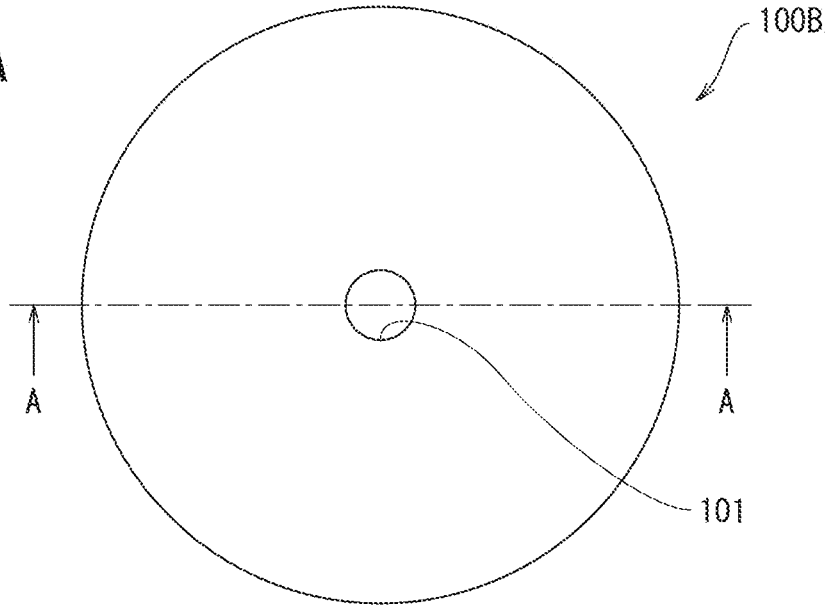
FIGS. 22A and 22B are drawings illustrating a polishing pad of a comparative example relative to the eleventh embodiment.
Figure 22B:
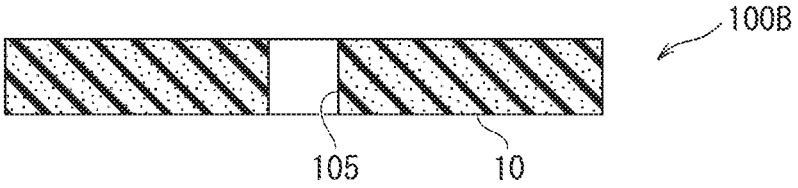

As illustrated in FIGS. 22A and 22B, a polishing pad 100B of Sample No. 29 is formed of foamed polyurethane and has a disc shape having a center hole 105. The polishing pad 100B has the diameter of 90 mm, the center hole of 20 mm, and the thickness of 10 mm.

[Sample No. 30]

Figure 23A:
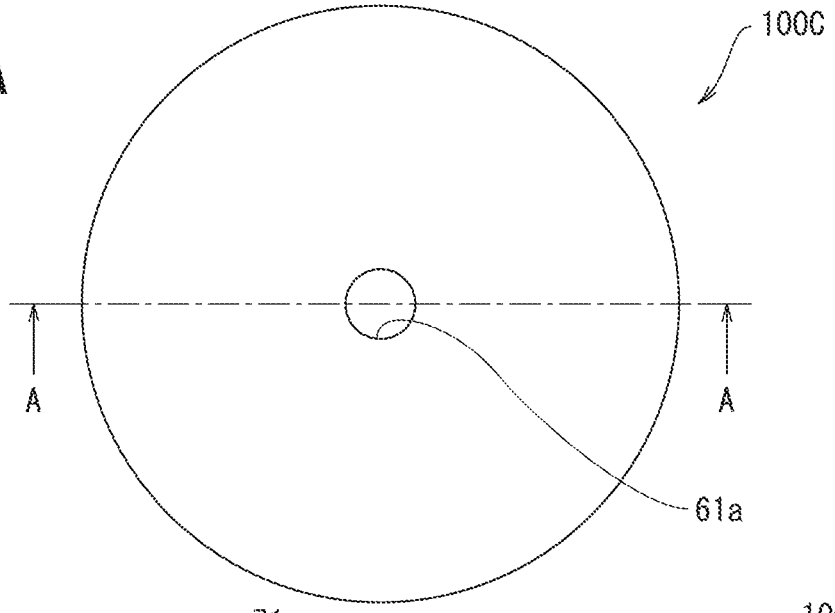
FIGS. 23A and 23B are drawings illustrating a polishing pad of a comparative example relative to the twelfth embodiment.
Figure 23B:
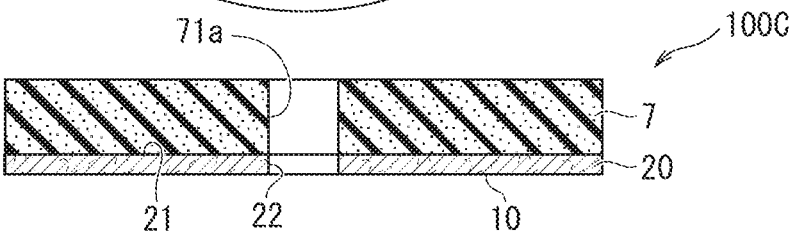

As illustrated in FIGS. 23A and 23B, the polishing pad 100B of Sample No. 30 is formed of the polishing layer 20 having the center hole 22 and the support layer 7 having a center hole 71*a*.

The polishing layer 20 is the nonwoven fabric type polishing pad with the outer diameter of 90 mm, the center hole 22 of 10 mm, and the thickness of 1.3 mm. The support layer 7 is made of foamed polyurethane and has the diameter of 90 mm, the center hole of 10 mm, and the thickness of 10 mm. The support layer 7 is fixed to the opposite surface 21 to the polishing surface 10 of the polishing layer 20.

[Testing Method]

A polish test was conducted using the polishing pad of each sample by the following method.

Objects to be polished are metal plates of 300×250 mm coated with synthetic resin coating and the thickness of the coated film is 20 μm. That is, the polished surface is the planar-shaped coated film surface made of the synthetic resin, and the polishing surface is smaller than the polished surface.

A polishing device used is a device where a double action polishing disc is mounted to a distal end of an arm of "M-20iA", an industrial robot manufactured by FANUC CORPORATION. While the polishing pad of each sample was pressed against the polished surface held horizontally by pressing force given to the arm and the slurry was dropped to the polished surface, the polishing disc was rotated for polishing.

The slurry was dropped to the outside (a position away of 30 mm from the outer peripheral surface) of the polishing pad in No. 21 to No. 24 and Nos. 27 and 30, and was dropped from the center hole of the polishing pad in Nos. 25, 26, 29, and 30. Polish conditions other than this were identical among all samples.

The used slurry contains alumina abrasives with the average grain diameter of 0.4 μm. The used slurry has viscosity of 0.11 Pa·s (1.1 cP) at 25° C. The average grain diameter of abrasives was measured using the particle diameter distribution measuring device "Horiba L-950" manufactured by HORIBA, Ltd.

This polishing was performed by three sets in each sample to examine whether the dropped slurry soaked through the polishing pad and the soaked slurry dispersed into the outside. Consequently, since the soak was not recognized from the polishing pads No. 21 to No. 26 including the water stop portion, the dispersion was not recognized as well. In contrast to this, the soak was recognized from the polishing pads No. 27 to No. 30 absent of the water stop portion and the dispersion of the soaked slurry was also recognized.

Table 3 shows the configuration (the difference) of the polishing pad of each sample and the test results.

TABLE 3

| | Configuration of polishing pad (difference) | | | | Position to which | | |
|---|---|---|---|---|---|---|---|
| No. | Support layer | Center hole | Water stop portion | Corresponding diagram | polishing slurry is dropped | Test result | Remarks |
| 21 | Absent | Absent | Entire | FIG. 14 | Outside of pad | Good | Example |
| 22 | Present | Absent | Entire support layer | FIG. 15 | Outside of pad | Good | Example |
| 23 | Absent | Absent | Outer peripheral portion | FIG. 16 | Outside of pad | Good | Example |
| 24 | Present | Absent | Outer peripheral portion of support layer | FIG. 17 | Outside of pad | Good | Example |
| 25 | Absent | Present | Wall surface of center hole | FIG. 18 | From center hole | Good | Example |
| 26 | Present | Present | Wall surface of center hole of support layer | FIG. 19 | From center hole | Good | Example |
| 27 | Absent | Absent | Absent of water stop portion | FIG. 20 | Outside of pad | Poor | Comparative example |

TABLE 3-continued

| No. | Configuration of polishing pad (difference) Support layer | Center hole | Water stop portion | Corresponding diagram | Position to which polishing slurry is dropped | Test result | Remarks |
|---|---|---|---|---|---|---|---|
| 28 | Present | Absent | Absent of water stop portion | FIG. 21 | Outside of pad | Poor | Comparative example |
| 29 | Absent | Present | Absent of water stop portion | FIG. 22 | From center hole | Poor | Comparative example |
| 30 | Present | Present | Absent of water stop portion | FIG. 23 | From center hole | Poor | Comparative example |

It has been found from these results that providing the water stop portion causes the slurry to be likely to soak through the polishing pad and the usage efficiency of the slurry becomes high.

REFERENCE SIGNS LIST

1 polishing pad
1A polishing pad
1B polishing pad
1C polishing pad
1D polishing pad
1E polishing pad
10 polishing surface
11 end portion of polishing pad
111 peripheral surface of end portion (peripheral surface on polishing surface side in axial direction)
12 base portion of polishing pad
121 surface on side opposite to polishing surface of polishing pad
2 support layer
3 polishing pad with support layer
4 main body of polishing pad
41 center hole of main body (through-hole penetrating interconnected cell layer)
5 water stop portion
51 water stop portion
51*a* center hole of water stop portion
6 polishing pad
60 polishing surface
61 end portion of polishing pad
611 peripheral surface of end portion (peripheral surface on polishing surface side in axial direction)
62 base portion of polishing pad
621 surface on side opposite to polishing surface of polishing pad
7 support layer
71 center hole of support layer (second through-hole)
8 polishing pad with support layer
9 polishing disc
91 base portion of polishing disc
92 rotation shaft of polishing disc
93 main body of polishing disc
15 slurry
16 slurry supply device
17 surface on side opposite to polishing surface of polishing pad
20 polishing layer
21 opposite surface to polishing surface of polishing layer
22 center hole of polishing layer (first through-hole)
30 support layer
50 polished surface
103 first groove
104 second groove
θ angle formed by peripheral surface of end portion and polishing surface

The invention claimed is:

1. A polishing method comprising:

providing a disc-shaped polishing pad, wherein:

the polishing pad has a peripheral surface on a polishing surface side in an axial direction of a disc of a tapered surface whose diameter is reduced to the polishing surface;

the polishing pad has an angle formed by the peripheral surface on the polishing surface side and the polishing surface of 125° or more and less than 180°; and the polishing pad has a hardness of 40 or more, determined according to Annex 2 of JIS K7312: 1996, "Spring Hardness Test Type C Testing Method";

supplying a slurry containing abrasives to a polished surface larger than the polishing surface; and pressing the polishing surface against the polished surface and moving the polishing pad to polish the polished surface, wherein the polished surface is a concave curved surface that is a coated film surface of part of a vehicle, a railway vehicle, an aircraft, a bicycle, or a ship.

2. The polishing method according to claim 1, wherein the polishing surface has a diameter of 10 mm or more and 200 mm or less.

3. The polishing method according to claim 1, wherein a support layer softer than the polishing pad is fixed to a surface on a side opposite to the polishing surface of the polishing pad.

4. The polishing method according to claim 1, wherein the polished surface is a surface made of a synthetic resin.

5. The polishing method according to claim 1, wherein a support layer softer than the polishing pad is fixed to a surface on a side opposite to the polishing surface of the polishing pad, and the support layer has a thickness of 2.0 mm or more and 50 mm or less.

6. A polishing method comprising:

providing a disc-shaped polishing pad, wherein:

the polishing pad has a peripheral surface on a polishing surface side in an axial direction of a disc of an arc surface; and the polishing pad has a hardness of 40 or more, determined according to Annex 2 of JIS K7312: 1996, "Spring Hardness Test Type C Testing Method";

supplying a slurry containing abrasives to a polished surface larger than the polishing surface; and pressing the polishing surface against the polished surface and moving the polishing pad to polish the polished surface, wherein the polished surface is a concave curved surface that is a coated film surface of part of a vehicle, a railway vehicle, an aircraft, a bicycle, or a ship.

7. The polishing method according to claim 6, wherein the polishing surface has a diameter of 10 mm or more and 200 mm or less.

8. The polishing method according to claim 6, wherein a support layer softer than the polishing pad is fixed to a surface on a side opposite to the polishing surface of the polishing pad, and the support layer has a thickness of 2.0 mm or more and 50 mm or less.

9. A polishing method comprising:

supplying a slurry containing abrasives to a polished surface;

providing a polishing pad in which having a hardness of 40 or more and 80 or less, determined according to Annex 2 of JIS K7312: 1996 "Spring Hardness Test Type C Testing Method"; and pressing a polishing surface of the polishing pad against the polished surface and moving the polishing pad to polish the polished surface, wherein a support layer softer than the polishing pad is fixed to a surface on a side opposite to the polishing surface of the polishing pad, and the support layer has a thickness of 2.0 mm or more and 50 mm or less; and wherein the polished surface is a concave curved surface that is a coated film surface of part of a vehicle, a railway vehicle, an aircraft, a bicycle, or a ship.

10. The polishing method according to claim 9, wherein the polishing surface has a groove.

11. The polishing method according to claim 10, wherein the groove has a width of 0.5 mm or more and 5.0 mm or less.

12. The polishing method according to claim 9, wherein:

the polishing surface has a diameter of 10 mm or more and 200 mm or less, and the polishing surface is smaller than the polished surface.

* * * * *